US007887986B2

(12) United States Patent
Matsumoto et al.

(10) Patent No.: US 7,887,986 B2
(45) **Date of Patent: *Feb. 15, 2011**

(54) METHOD OF MANUFACTURING TONER PARTICLES, TONER PARTICLES, TWO-COMPONENT DEVELOPER, DEVELOPING DEVICE AND IMAGE FORMING APPARATUS

(75) Inventors: Katsuru Matsumoto, Nara (JP); Keiichi Kikawa, Osaka (JP); Nobuhiro Maezawa, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 69 days.

This patent is subject to a terminal disclaimer.

(21) Appl. No.: 12/188,495

(22) Filed: Aug. 8, 2008

(65) Prior Publication Data

US 2009/0042119 A1 Feb. 12, 2009

(30) Foreign Application Priority Data

Aug. 8, 2007 (JP) ..... P2007-207068

(51) Int. Cl.
*G03G 9/08* (2006.01)

(52) U.S. Cl. ..... 430/137.14; 430/137.1

(58) Field of Classification Search ..... 430/137.14, 430/137.1

See application file for complete search history.

(56) References Cited

U.S. PATENT DOCUMENTS 5,424,162 A 6/1995 Kohri et al.
5,843,614 A 12/1998 Shinzo et al.
5,885,743 A 3/1999 Takayanagi et al.
6,017,670 A 1/2000 Hashizume et al.
6,270,708 B1 8/2001 Gurol
7,284,899 B2 10/2007 Nakano
7,402,371 B2 7/2008 Sacripante et al.
2002/0042014 A1* 4/2002 Fujino et al. ..... 430/137.17
2002/0160289 A1 10/2002 Teshima et al.
2004/0110078 A1 6/2004 Teshima et al.
2005/0041523 A1 2/2005 Nakano
2006/0160012 A1 7/2006 Hirose et al.
2007/0128533 A1 6/2007 Sata et al.

(Continued)

FOREIGN PATENT DOCUMENTS

JP 03-056969 3/1991

(Continued)

OTHER PUBLICATIONS

U.S. Office Action mailed Nov. 21, 2008 in corresponding U.S. Appl. No. 11/652,482.

*Primary Examiner*—Hoa V Le
(74) *Attorney, Agent, or Firm*—Nixon & Vanderhye P.C.

(57) ABSTRACT

A method of manufacturing toner particles capable of decreasing the manufacturing costs by simplifying the manufacturing apparatus and by decreasing the number of the steps, as well as to provide toner particles, a two-component developer, a developing apparatus and an image forming apparatus are provided. A high-pressure homogenizer is constituted by a tank, a feed pump, a high-pressure pump, a heat exchanger, a nozzle, a first depressurizing module, a cooling unit, a second depressurizing module and a take-out port arranged in this order. A flow path constituted in the first depressurizing module has a straight portion tilted with respect to a direction in which the aqueous slurry passes and a portion for relaxing the flow of the aqueous slurry.

10 Claims, 5 Drawing Sheets

U.S. PATENT DOCUMENTS

| | | | | |
|---|---|---|---|---|
| 2007/0166638 | A1 | 7/2007 | Matsumoto et al. | |
| 2007/0196754 | A1 | 8/2007 | Matsumoto et al. | |
| 2008/0029924 | A1* | 2/2008 | Maezawa et al. | 264/117 |
| 2008/0063970 | A1* | 3/2008 | Kikawa et al. | 430/110.2 |
| 2010/0021210 | A1* | 1/2010 | Maezawa et al. | 399/252 |

FOREIGN PATENT DOCUMENTS

| | | | |
|---|---|---|---|
| JP | 04-174861 | | 6/1992 |
| JP | 07-075666 | | 8/1995 |
| JP | 08-146657 | | 6/1996 |
| JP | 09-277348 | | 10/1997 |
| JP | 10-186714 | | 7/1998 |
| JP | 63-278547 | A | 11/1998 |
| JP | 2001-209212 | | 8/2001 |
| JP | 2001-324831 | | 11/2001 |
| JP | 2002-351140 | A | 12/2002 |
| JP | 2003-066649 | | 3/2003 |
| JP | 2003-345063 | A | 12/2003 |
| JP | 2005-128176 | | 5/2005 |
| JP | 2005-165039 | | 6/2005 |
| JP | 2006-91882 | | 4/2006 |
| JP | 2006-189710 | | 7/2006 |
| JP | 2007-34290 | A | 2/2007 |
| JP | 2007-108458 | | 4/2007 |
| WO | 01/84248 | A1 | 11/2001 |
| WO | WO03/059497 | | 7/2003 |

* cited by examiner

METHOD OF MANUFACTURING TONER PARTICLES, TONER PARTICLES, TWO-COMPONENT DEVELOPER, DEVELOPING DEVICE AND IMAGE FORMING APPARATUS

CROSS-REFERENCE TO RELATED APPLICATION

This application claims priority to Japanese Patent Application No. 2007-207068, which was filed on Aug. 8, 2007, the contents of which are incorporated herein by reference in its entirety.

BACKGROUND OF THE INVENTION

1. Field of the Invention

The present invention relates to a method of manufacturing toner particles, toner particles, a two-component developer, a developing device and an image forming apparatus.

2. Description of the Related Art

A toner for visualizing latent images has been used in various image forming processes, and an electrophotographic method may be one of the examples.

In an image forming apparatus of the electrophotographic system, a toner which is electrically charged is fed to an electrostatic latent image formed on the surface of a photoreceptor to develop the electrostatic latent image into a toner image which is, thereafter, fixed on a recording medium to form an image. According to this system, the toner is uniformly attached onto the electrostatic latent image to form an image having a high image density and excellent image quality. From the standpoint of adhering the toner onto the electrostatic latent image, it is important that the toner has even particle sizes, the width of particle size distribution is narrow, and the electrically charging property is uniform. The particle size of the toner affects not only the electrically-charging property but also the reproduction of image of the manuscript maintaining high degree of fineness. The toner having suitably small particle sizes, i.e., particle sizes of about 5 to about 6 μm is effective in obtaining highly finely copied images. Therefore, a study has been conducted extensively to obtain toners having even and small particle sizes. For example, an aggregation method has been known to obtain a toner having even particle sizes. According to the aggregation method, an aggregating agent such as a divalent or trivalent metal salt is added to an aqueous slurry in which fine resin particles, coloring agent particles and releasing agent particles are dispersed so as to aggregate the resin particles, coloring agent particles and releasing agent particles to thereby prepare aggregated particles that serve as a toner. The aggregation method involves problems that must be solved; i.e., excess aggregation takes place forming aggregated particles having too large particle sizes, the aggregation reaction must be conducted for extended periods of time to control the particle size of the aggregated particles, coloring agent particles are unhomogeneously exposed on the surfaces of the aggregated particles causing the electrically charging property of the individual aggregated particles to be dispersed, and releasing agent particles are exposed on the surfaces of the aggregated particles and are melted forming a film that adheres to the surfaces of the photoreceptor becoming a cause of defective image.

In view of the above-mentioned problems, a method of manufacturing a toner has been proposed by aggregating the resin particles and the coloring agent under a heated condition in aqueous medium, for example, in the presence of an aggregating agent, the resin particles being those obtained by polymerizing a polymerizable monomer in the presence of a surfactant having a polymerizable unsaturated group (see, for example, Japanese Unexamined Patent Publication JP-A 2003-345063). According to JP-A 2003-345063, the surfactant having the polymerizable unsaturated group is a nonionic surfactant having a polymerizable unsaturated group including a vinyl bond. As the aggregating agent, there can be used a divalent metal salt such as alkali metal salt, alkaline earth metal salt, manganese or copper, or a trivalent metal salt such as of iron or aluminum.

There has further been proposed a method of manufacturing capsule particles by a batch system by homogenizing mother particles having a number average particle size of 0.1 to 100 μm and child particles having a number average particle size not larger than one-fifth the number average particle size of the mother particles under an injection pressure of not smaller than 29.4 MPa (300 kgf/cm$^2$) so as to aggregate the child particles on the surfaces of the mother particles (see, for example, Japanese Examined Patent Publication JP-B2 7-75666 (1995)). According to the technology of JP-B2 7-75666, the pressure must be elevated to be not smaller than 54.8 MPa in order to obtain particles having even particle sizes while preventing the occurrence of excess aggregation.

A melt-emulsified aggregation method has been known for manufacturing a fine toner having a small particle size without dispersion in the electrically charging property. According to the melt-emulsified aggregation method, the toner particle size is controlled by passing fine particles through a coiled pipe to impart a centrifugal force thereto in the step of aggregating the fine particles manufactured by a high-pressure homogenizing method.

However, the manufacturing apparatus becomes complex in constitution and requires an increased number of steps driving up the costs of manufacturing.

SUMMARY OF THE INVENTION

It is, therefore, an object of the invention to provide a method of manufacturing toner particles capable of decreasing the manufacturing costs by simplifying a manufacturing apparatus and by decreasing the number of steps, as well as to provide toner particles, a two-component developer, a developing device and an image forming apparatus.

The invention provides a method of manufacturing toner particles comprising:

an aggregating step of obtaining an aqueous slurry of aggregated particles by passing an aqueous slurry of fine resin particles through a depressurizing module under heated and reduced pressure conditions; and a cooling step of cooling the aqueous slurry of aggregated particles.

According to the invention, in the aggregating step, the aqueous slurry of aggregated particles is obtained by passing the aqueous slurry of fine resin particles through the depressurizing module under heated and reduced pressure conditions, and in the cooling step, the aqueous slurry of aggregated particles is cooled.

This makes it possible to aggregate fine particles and, at the same time, to adjust the particle size of the aggregated particles, as well as to decrease the manufacturing costs by simplifying the apparatus and by decreasing the number of the steps, avoiding the risk of blocking the apparatus.

In the invention, it is preferable that a flow path constituted in the depressurizing module has a straight portion that is tilted with respect to a direction in which the aqueous slurry passes and a portion for relaxing the flow of the aqueous slurry.

According to the invention, the flow path constituted in the depressurizing module has a straight portion that is tilted with respect to a direction in which the aqueous slurry passes and the portion for relaxing the flow of the aqueous slurry.

In the first depressurizing module, therefore, a flow that contributes to the aggregation and a flow that contributes to the atomization are created simultaneously making it possible to control the particle size of the aggregated particles. As a result, a toner is obtained having a sharp particle size distribution and a desired very small particle size.

In the invention, it is preferable that the depressurizing module is constituted by alternately stacking ring-like members and cylindrical members in concentric, and the cylindrical members form a flow path that penetrates through in the axial direction and is tilted with respect to the axis.

According to the invention, further, the depressurizing module is constituted by alternately stacking the ring-like members and the cylindrical members in concentric, and the cylindrical members form the flow path that penetrates through in the axial direction and is tilted with respect to the axis.

This makes it possible to obtain the toner having a sharp particle size distribution and a desired very small particle size.

In the invention, it is preferable that the liquid temperature of the aqueous slurry in the depressurizing module is from 60 to 90° C. in the aggregating step.

In the aggregating step according to the invention, the liquid temperature of the aqueous slurry in the depressurizing module is from 60 to 90° C.

This makes it possible to control the particle size and the particle size distribution so to assume desired values.

In the invention, it is preferable that two or more depressurizing modules are connected in series to pass the aqueous slurry in the aggregating step.

In the aggregating step according to the invention, two or more depressurizing modules are connected in series to pass the aqueous slurry.

This makes it possible to obtain the toner having a sharp particle size distribution and a desired very small particle size.

In the invention, it is preferable that the aqueous slurry of fine resin particles contains a cationic aggregating agent.

According to the invention, the aqueous slurry of the fine resin particles contains the cationic aggregating agent.

This enables the aggregation to smoothly proceed and makes it possible to obtain the toner having a sharp particle size distribution and a desired very small particle size.

In the invention, it is preferable that the cationic aggregating agent is contained in an amount of 0.1 to 5% by weight based on the whole amount of the aqueous slurry of fine resin particles.

In the invention, it is preferable that the cationic aggregating agent comprises one or two or more selected from potassium chloride, sodium chloride, calcium chloride, magnesium chloride and aluminum chloride.

Further, according to the invention, the cationic aggregating agent can use one or two or more selected from potassium chloride, sodium chloride, calcium chloride, magnesium chloride and aluminum chloride.

In the invention, it is preferable that the aqueous slurry of fine resin particles further contains an anionic dispersant.

According to the invention, the aqueous slurry of fine resin particles further contains the anionic dispersant.

This helps improve the effect of the cationic aggregating agent that is added.

In the invention, further, it is preferable that the anionic dispersant is contained in an amount of 0.1 to 5% by weight based on the whole amount of the aqueous slurry of fine resin particles.

In the invention, it is preferable that the anionic dispersant comprises one or two or more selected from sulfonic acid anionic dispersant, sulfuric acid ester anionic dispersant, phosphoric acid ester anionic dispersant and polyacrylate.

According to the invention, the anionic dispersant can use one or two or more selected from sulfonic acid anionic dispersant, sulfuric acid ester anionic dispersant, phosphoric acid ester anionic dispersant and polyacrylate.

The invention further provides toner particles manufactured by the above mentioned method.

According to the invention, a toner particle of the invention is manufactured by the above mentioned method.

A toner composed of the thus obtained toner particles has a small particle size, a uniform shape and a sharp particle size distribution and, therefore, features excellent electrically charging property and forms images of high quality.

The invention further provides a two-component developer containing a toner composed of the toner particles mentioned above and a carrier.

According to the invention, the two-component developer contains the toner composed of the toner particles above mentioned and the carrier, and does not form filming on the photoreceptor that stems from the bleed-out of wax or does not develop offset phenomenon in high temperature regions, making it possible to form highly fine images having high resolution and high quality.

The invention further provides a developing device for effecting the developing by using a developer containing a toner composed of the toner particles mentioned above or the two-component developer mentioned above.

According to the invention, the developing device effects the developing by using the developer containing the toner composed of the toner particles mentioned above or the two-component developer mentioned above, and forms highly fine toner images having high resolution and high quality on the photoreceptor.

The invention provides an image forming apparatus having the developing device mentioned above.

According to the invention, the image forming apparatus has the developing device mentioned above, and excellently reproduces images of a manuscript, and is capable of forming highly fine images having high resolution and high quality.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
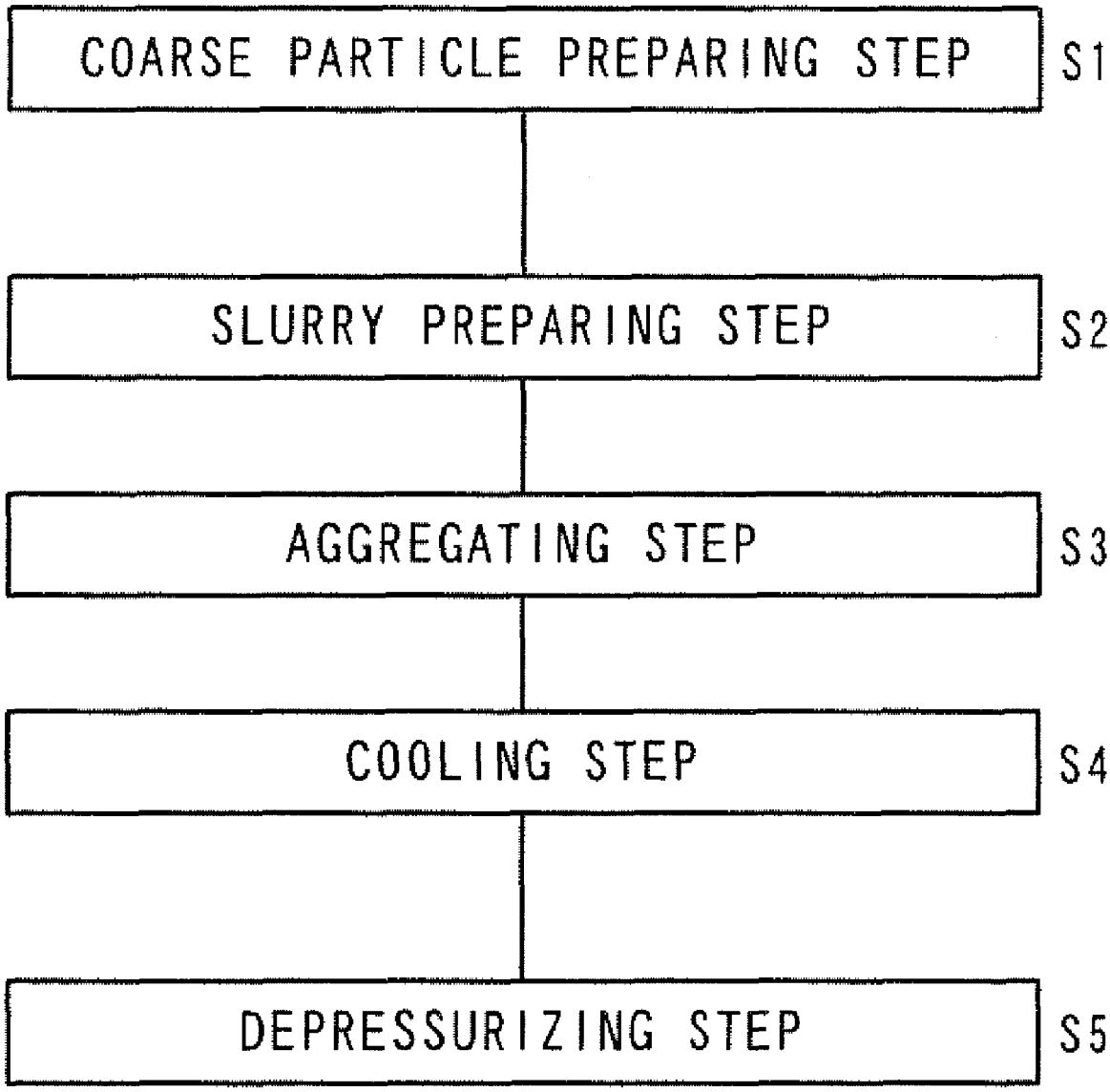
FIG. 1 is a diagram of steps schematically illustrating a method of manufacturing a toner according to the invention.

Now referring to the drawings, preferred embodiments of the invention are described below.

This invention is concerned with a method of manufacturing toner particles which are aggregates of fine resin particles.

In an aggregating step, first, an aqueous slurry of aggregated particles is obtained by passing an aqueous slurry of fine resin particles through a depressurizing module under heated and reduced pressure conditions and in a cooling step, the aqueous slurry of aggregated particles is cooled.

Fine resin particles contained in the aqueous slurry will now be described.

The fine resin particles preferably have a volume average particle size of not larger than 2 μm and, more preferably, a volume average particle size of 0.4 to 2 μm. If the volume average particle size is smaller than 0.4 μm, an extended period of time is required for achieving a target particle size of the aggregated particles, which is inefficient. If the volume average particle size exceeds 3 μm, on the other hand, inconvenience is accompanied when it is attempted to use aggregated particles of fine resin particles as the toner. More concretely, if the volume average particle size of the fine resin particles exceeds 2 μm, it becomes difficult to obtain aggregated particles having suitably decreased sizes of a volume average particle size of about 5 to about 6 μm that are advantageous for highly finely reproducing images of a manuscript. The fine resin particles are, preferably, those of a granulated synthetic resin. There is no particular limitation on the synthetic resin provided it can be granulated in a molten state, and there can be used, for example, polyvinyl chloride, polyvinyl acetate, polyethylene, polypropylene, polyester, polyamide, styrene polymer, (meth)acrylic resin, polyvinyl butylal, silicone resin, polyurethane, epoxy resin, phenol resin, xylene resin, rosin-modified resin, terpene resin, aliphatic hydrocarbon resin, alicyclic hydrocarbon resin and aromatic petroleum resin. The synthetic resins may be used each alone or two or more of them may be used in combination. Among them, it is preferred to use polyester, styrene polymer, (meth) acrylic acid polymer, polyurethane and epoxy resin which are capable of easily forming particles having a high degree of surface smoothness relying upon the wet granulation in an aqueous system.

Known polyester can be used such as a polycondensate of a polybasic acid and a polyhydric alcohol. As the polybasic acid, there can be used those known as monomers for polyesters, for example, aromatic carboxylic acids such as terephthalic acid, isophthalic acid, phthalic anhydride, trimellitic anhydride, pyromellitic acid, and naphthalenedicarboxylic acid; aliphatic carboxylic acids such as maleic anhydride, fumaric acid, succinic acid, alkenyl succinic anhydride and adipic acid; and methyl esterified products of these polybasic acids. The polybasic acids may be used each alone or two or more of them may be used in combination. Known as the polyhydric alcohols, there can be used those known as monomers for polyesters, for example, aliphatic polyhydric alcohols such as ethylene glycol, propylene glycol, butane diol, hexane diol, neopentyl glycol and glycerin; alicyclic polyhydric alcohols such as cyclohexane diol, cyclohexane dimethanol and hydrogenated bisphenol A; and aromatic diols such as ethylene oxide adduct of bisphenol A and propylene oxide adduct of bisphenol A. The polyhydric alcohols may be used each alone or two or more of them may be used in combination. The polycondensation reaction of a polybasic acid with a polyhydric alcohol can be conducted according to a customary manner, such as bringing the polybasic acid into contact with the polyhydric alcohol in the presence or absence of an organic solvent and in the presence of a polycondensation catalyst, and is terminated at a moment when the acid value or the softening temperature of the formed polyester has assumed a predetermined value. Polyester is thus obtained. If a methyl esterified product of a polybasic acid is used as part of the polybasic acid, then the demethylation polycondensation reaction is effected. In the polycondensation reaction, the blending ratio and the conversion of the polybasic acid and the polyhydric alcohol can be suitably varied to adjust, for example, the content of carboxyl groups at the terminal of the polyester and, therefore, to modify the properties of the obtained polyester. Further, if the trimellitic anhydride is used as the polybasic acid, the carboxyl group can be easily introduced into the main chain of the polyester to obtain a modified polyester. Further, a hydrophilic group such as carboxyl group or sulfonic acid group may be bonded to the main chain and/or the side chain of the polyester to use a self-dispersing polyester in water.

As the styrene polymer, there can be used a homopolymer of a styrene monomer, or a copolymer of a styrene monomer and a monomer copolymerizable with the styrene monomer. As the styrene monomer, there can be exemplified styrene, o-methylstyrene, ethylstyrene, p-methoxystyrene, p-phenylstyrene, 2,4-dimethylstyrene, p-n-octylstyrene, p-n-decylstyrene and p-n-dodecylstyrene. Other monomers may be (meth) acrylic acid esters such as methyl(meth)acrylate, ethyl(meth) acrylate, propyl(meth)acrylate, butyl(meth)acrylate, isobutyl (meth)acrylate, n-octyl(meth)acrylate, dodecyl(meth)acrylate, 2-ethylhexyl(meth)acrylate, stearyl(meth)acrylate, phenyl(meth)acrylate, and dimethylaminoethyl(meth)acrylate; (meth)acrylic monomers such as acrylonitrile, methacrylamide, glycidylmethacrylate, N-methylolacrylamide, N-methylolmethacrylamide, and 2-hydroxyethylacrylate; vinyl ethers such as vinylmethyl ether, vinylethy ether and vinylisobutyl ether; vinylketones such as vinylmethylketone, vinylhexylketone, and methylisopropenylketone; and N-vinyl compounds such as N-vinylpyrrolidone, N-vinylcarbasole, and N-vinylindole. The styrene monomers and the monomers copolymerizable with the styrene monomers may be used each alone or two or more of them may be used in combination.

As the (meth)acrylic resin, there can be exemplified homopolymes of (meth)acrylic acid esters and copolymers of (meth)acrylic acid esters and monomers copolymerizable with the (meth)acrylic acid esters. As the (meth)acrylic acid esters, there can be used those described above. As the monomers copolymerizable with the (meth)acrylic acid esters, there can be used (meth)acrylic monomers, vinyl ethers, vinylketones and N-vinyl compounds They may be those described above. As the (meth)acrylic resin, there can be used an acidic group-containing acrylic resin. The acidic group-containing acrylic resin can be produced by, for example, using an acrylic resin monomer having an acidic group or a hydrophilic group and/or a vinyl monomer having an acidic group or a hydrophilic group at the time of polymerizing the acrylic resin monomer or the acrylic resin monomer and a vinyl monomer. A known acrylic resin monomer can be used, such as an acrylic acid that may have a substituent, a methacrylic acid that may have a substituent, or an acrylic acid ester that may have a substituent and a methacrylic acid ester that may have a substituent. The acrylic resin monomers may be used each alone or two or more of them may be used in combination. A known vinyl monomer can be used, such as styrene, α-methylstyrene, vinyl bromide, vinyl chloride, vinyl acetate, acrylonitrile or methacrylonitrile. The vinyl monomers may be used each alone or two or more of them may be used in combination. The styrene polymer and the (meth)acrylic resin are polymerized by the solution polymerization, suspension polymerization or emulsion polymerization, using a general radical starting agent.

Though there is no particular limitation on the polyurethane, there is preferably used a polyurethane containing an acidic group or a basic group. The acidic group- or basic group-containing polyurethane can be produced according to a known method. For example, an acidic group- or basic group-containing diol, polyol and polyisocyanate may be addition-polymerized. As the acid-group or basic group-containing diol, there can be exemplified dimethylolpropionic acid and N-methyldiethanolamine. As the polyol, there can be exemplified polyetherpolyol such as polyethylene glycol, as well as polyesterpolyol, acrylpolyol and polybutadienepolyol. As the polyisocyanate, there can be exemplified tolylene diisocyanate, hexamethylene diisocyanate and isophorone diisocyanate. These components may be used each alone or two or more of them may be used in combination. Though there is no particular limitation on the epoxy resin, an acidic group- or basic group-containing epoxy resin can be preferably used. The acidic group- or basic group-containing epoxy resin can be prepared by, for example, adding or addition-polymerizing an adipic acid and a polyhydric carboxylic acid such as trimellitic anhydride or an amine such as dibutylamine or ethylenediamine with the epoxy resin that serves as a base.

The finally obtained aggregated particles are used as the toner. Among the synthetic resins, therefore, the polyester is preferred. The polyester has excellent transparency, works to impart favorable powder fluidity, low-temperature fixing property and secondary color reproduceability to the aggregated particles, and is desirable as a binder resin for color toners. Further, the polyester and the acrylic resin may be used upon being grafted. Among these synthetic resins, it is desired to use a synthetic resin having a softening temperature of not higher than 150° C. from the standpoint of easy granulation operation for preparing fine resin particles, kneading the synthetic resin with the additives, and further uniformalizing the shape and size of the fine resin particles. More particularly, it is desired to use a synthetic resin having a softening temperature of 60 to 150° C. Among them, further, it is desired to use a synthetic resin having a weight average molecular weight of 5,000 to 500,000. The synthetic resins may be used each alone or two or more which are different of them may be used in combination. Further, even the same kind of resin may include a plurality of those having different molecular weights or different monomer compositions, or having both different molecular weights and monomer components.

The invention may use a self-dispersion type resin as the synthetic resin. The self-dispersion type resin is a resin having a hydrophilic group in the molecules thereof and disperses in a liquid such as water. The hydrophilic group may be —COO— group, —$SO_3$— group, —CO group, —OH group, —$OSO_3$— group, —$PO_3H_2$ group, —$PO_4$— group or a salt thereof. Among them, an anionic hydrophilic group is particularly preferred, such as —COO— group or —$SO_3$— group. The self-dispersion type resin having one or two or more of such hydrophilic groups disperses in water without using the dispersant or using the dispersant in very small amounts. Though there is no particular limitation on the amount of the hydrophilic groups contained in the self-dispersion type resin, it is desired that the amount of the hydrophilic groups is, preferably, 0.001 to 0.050 mols and, more preferably, 0.005 to 0.030 mols based on 100 g of the self-dispersion type resin. The self-dispersion type resin can be manufactured by, for example, bonding a compound having a hydrophilic group and an unsaturated double bond (hereinafter referred to as "hydrophilic group-containing compound") to the resin. The hydrophilic group-containing compound can be bonded to the resin by such a method as graft polymerization or block polymerization. The self-dispersion type resin can be further manufactured by polymerizing the hydrophilic group-containing compound or by polymerizing the hydrophilic group-containing compound and a compound copolymerizable therewith.

As the resin to which the hydrophilic group-containing compound is to be bonded, there can be exemplified styrene resins such as polystyrene, poly-α-methylstyrene, chloropolystyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylic acid ester copolymer, styrene-methacrylic acid ester copolymer, styrene-acrylic acid ester-methacrylic acid ester copolymer, styrene-methyl α-chioroacrylate copolymer, styrene-acrilonitrile-acrylic acid ester copolymer, and styrene-vinyl methyl ether copolymer; as well as (meth)acrylic resin, polycarbonate, polyester, polyethylene, polypropylene, polyvinyl chloride, epoxy resin, urethane-modified epoxy resin, silcone-modified epoxy resin, rosin-modified maleic acid resin, ionomer resin, polyurethane, silicone resin, ketone resin, ethylene-ethyl acrylate copolymer, xylene resin, polyvinyl butyral, terpene resin, phenol resin, aliphatic hydrocarbon resin and alicyclic hydrocarbon resin.

As the hydrophilic group-containing compound, there can be exemplified unsaturated carboxylic acid compound and unsaturated sulfonic acid compound. As the unsaturated carboxylic acid compound, there can be exemplified unsaturated carboxylic acids such as (meth)acrylic acid, crotonic acid and isocrotonic acid; unsaturated dicarboxylic acids such as maleic acid, fumaric acid, tetrahydrophthalic acid, itaconic acid and citraconic acid; acid anhydrides such as maleic anhydride and citraconic anhydride; as well as alkyl esters, dialkyl esters, alkali metal salts, alkaline earth metal salts and ammonium salts thereof. As the unsaturated sulfonic acid compound, there can be used, for example, styrenesulfonic acids, sulfoalkyl(meth)acrylates, metal salts thereof and ammonium salts thereof. The hydrophilic group-containing compounds can be used each alone or two or more of them may be used in combination. As the monomer compound other than the hydrophilic group-containing compounds, there can be used, for example, a sulfonic acid compound. As the sulfonic acid compound, there can be exemplified sulfoisophthalic acid, sulfoterephthalic acid, sulfophthalic acid, sulfosuccinic acid, sulfobenzoic acid, sulfosalicylic acid, metal salt thereof or ammonium salt thereof.

The synthetic resin used in the invention may contain one or two or more of additives for general synthetic resins. Concrete examples of the additive for the synthetic resin include inorganic fillers of various shapes (granular, fibrous, scale-like), coloring agents, releasing agent, charge control agent, flame-retarding agent, ultraviolet ray absorber, photo-stabilizer, light-shielding agent, metal inactivating agent, lubricant, impact strength-improving agent and compatibility-improving agent.

The finally obtained aggregated particles are used as the toner and have the coloring agent, releasing agent, charge control agent and the like contained in the synthetic resin.

There is no particular limitation on the coloring agent, and there can be used organic dye, organic pigment, inorganic die and inorganic pigment.

As the black coloring agent, there can be used, for example, carbon black, copper oxide, manganese dioxide, aniline black, active carbon, nonmagnetic ferrite, magnetic ferrite and magnetite.

As the yellow coloring agent, there can be exemplified chrome yellow, zinc yellow, cadmium yellow, yellow iron oxide, mineral fast yellow, nickel titanium yellow, naples yellow, naphthol yellow S, Hansa Yellow G, Hansa Yellow 10G, Benzidine Yellow G, Benzidine Yellow GR, quinoline yellow lake, permanent yellow NCG, Tartrazine Lake, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, and C.I. pigment yellow 139.

As the orange coloring agent, there can be exemplified red chrome yellow, molybdenum orange, permanent orange GTR, pyrazolone orange, Vulcan Orange, Indanthrene Brilliant Orange RK, benzidine orange G, Indanthrene Brilliant Orange GK, C.I. pigment orange 31, and C.I. pigment orange 43.

As the red coloring agent, there can be exemplified red ion oxide, cadmium red, red lead, mercury sulfide, cadmium, permanent red 4R, Lithol Red, Pyrazolone Red, Watchung Red, calcium salt, lake red C, lake red D, Brilliant Carmine 6B, eosine lake, Rhodamine Lake B, Alizarine Lake, Brilliant Carmine 3B, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1; C.I. pigment red 122, C.I. pigment red 123, C.I. pigment red 139, C.I. pigment red 144, C.I. pigment red 149, C.I. pigment red 166, C.I. pigment red 177, C.I. pigment red 178 and C.I. pigment red 222.

As the violet coloring agent, there can be exemplified manganese violet, fast violet B and methyl violet lake.

As the blue coloring agent, there can be exemplified Prussian blue, cobalt blue, alkali blue lake, Victoria blue lake, Phthalocyanine Blue, nonmetallic Phthalocyanine Blue, partial chloride of Phthalocyanine Blue, fast sky blue, Indanthrene Blue BC, C.I. pigment blue 15, C.I. pigment blue 15:2, C.I. pigment blue 15:3, C.I. pigment blue 16, and C.I. pigment blue 60.

As the green coloring agent, there can be exemplified chrome green, chrome oxide, pigment green B, malachite green lake, final yellow green G and C.I. pigment green 7.

As the white coloring agent, there can be exemplified such compounds as zinc flower, titanium oxide, antimony white and zinc sulfide.

The coloring agents may be used each alone or two or more of different colors may be used in combination. Or even their color may be the same, there can be used two or more of the coloring agents. Though there is no particular limitation on the content of the coloring agent in the fine resin particles, it is preferred that the content of the coloring agent is 0.1 to 20% by weight and, more preferably, 0.2 to 10% by weight based on the whole amount of the fine resin particles.

There is no particular limitation on the releasing agent, either, and there can be used, for example, petroleum type waxes such as paraffin wax or derivatives thereof and microcrystalline wax or derivatives thereof; hydrocarbon type synthetic waxes such as Fischer-Tropsch wax and derivatives thereof, polyolefin wax and derivatives thereof, low-molecular polypropylene wax and derivatives thereof and polyolefin polymer wax (low-molecular polyethylene wax, etc.) and derivatives thereof; plant type waxes such as carnauba wax and derivatives thereof, rice wax and derivatives thereof, candelilla wax and derivatives thereof and Japan wax; animal type waxes such as bees wax and whale wax; oil and fat type synthetic waxes such as fatty acid amide and phenolic fatty acid ester; as well as long-chain carboxylic acid and derivatives thereof, long-chain alcohol and derivatives thereof, silicone polymer and higher fatty acid. The derivatives may contain oxides, block copolymers of vinyl monomer and wax, and graft-modified products of vinyl monomer and wax. Among them, it is desired to use a wax having a melting point which is not smaller than the temperature of the aqueous solution containing the water-soluble dispersant. The content of the releasing agent in the fine resin particles can be suitably selected over a wide range without any particular limitation. Preferably, however, the content of the releasing agent is 0.2 to 20% by weight based on the whole amount of the fine resin particles.

There is no particular limitation on the charge control agent, and there can be used the one for controlling positive electric charge or the one for controlling negative electric charge. As the charge control agent for controlling positive electric charge, there can be exemplified basic dye, quaternary ammonium salt, quaternary phosphonium salt, aminopyrin, pyrimidine compound, polynuclear polyamino compound, aminosilane, nigrosine dye and derivatives thereof, triphenylmethane derivative, guanidine salt and amidine salt. As the charge control agent for controlling negative electric charge, there can be exemplified oil-soluble dyes such as oil black and spiro black; as well as metal-containing azo compound, azo complex dye, metal salt of naphthenic acid, metal complex and metal salt (metal is chrome, zinc, zirconium, etc.) of salicylic acid and derivatives thereof, fatty acid soap, long-chain alkylcarboxylate and resin acid soap. The charge control agents may be used each alone or, as required, two or more of them may be used in combination. The content of the charge control agent in the fine resin particles can be suitably selected over a wide range without any particular limitation. Preferably, however, the content of the charge control agent is 0.5 to 3% by weight based on the whole amount of the fine resin particles.

[Manufacturing Method of Fine Resin Particles]

The fine resin particles can be manufactured according to a known method of spheroidizing a synthetic resin but are desirably manufactured by a high-pressure homogenizing method. In this specification, the high-pressure homogenizing method is a method of spheroidizing the synthetic resin by using a high-pressure homogenizer, and the high-pressure homogenizer is a device for pulverizing or emulsifying the particles under the pressurized condition. The high-pressure homogenizers have been placed in the market or have been disclosed in patent documents. As the high-pressure homogenizer placed in the market, there can be exemplified chamber-type high-pressure homogenizers such as MICROFLUIDIZER (trade name, manufactured by Microfluidics Corporation), NANOMIZER (trade name, manufactured by Nanomizer Inc.) and ALTIMIZER (trade name, manufactured by Sugino Machine Ltd.), as well as HIGH-PRESSURE HOMOGENIZER (trade name, manufactured by Rannie Inc.), HIGH-PRESSURE HOMOGENIZER (trade name, manufactured by Sanmaru Machinery Co., Ltd.), and HIGH-PRESSURE HOMOGENIZER (trade name, manufactured by Izumi Food Machinery Co., Ltd.) As the high-pressure homogenizer disclosed in a patent document, there can be exemplified the one disclosed in, for example, WO03/059497. Among them, the high-pressure homogenizer disclosed in WO03/059497 is desired.

FIG. 1 is a diagram of steps schematically illustrating a method of manufacturing a toner according to the invention.

The manufacturing method shown in FIG. 1 includes a coarse particle preparing step S1, a slurry preparing step S2, an aggregating step S3, a cooling step S4 and a depressurizing step S5. Among those steps, the aggregating step S3, the cooling step S4 and the depressurizing step S5 are effected by using, for example, a high-pressure homogenizer 1 shown in FIG. 2.

Figure 2:
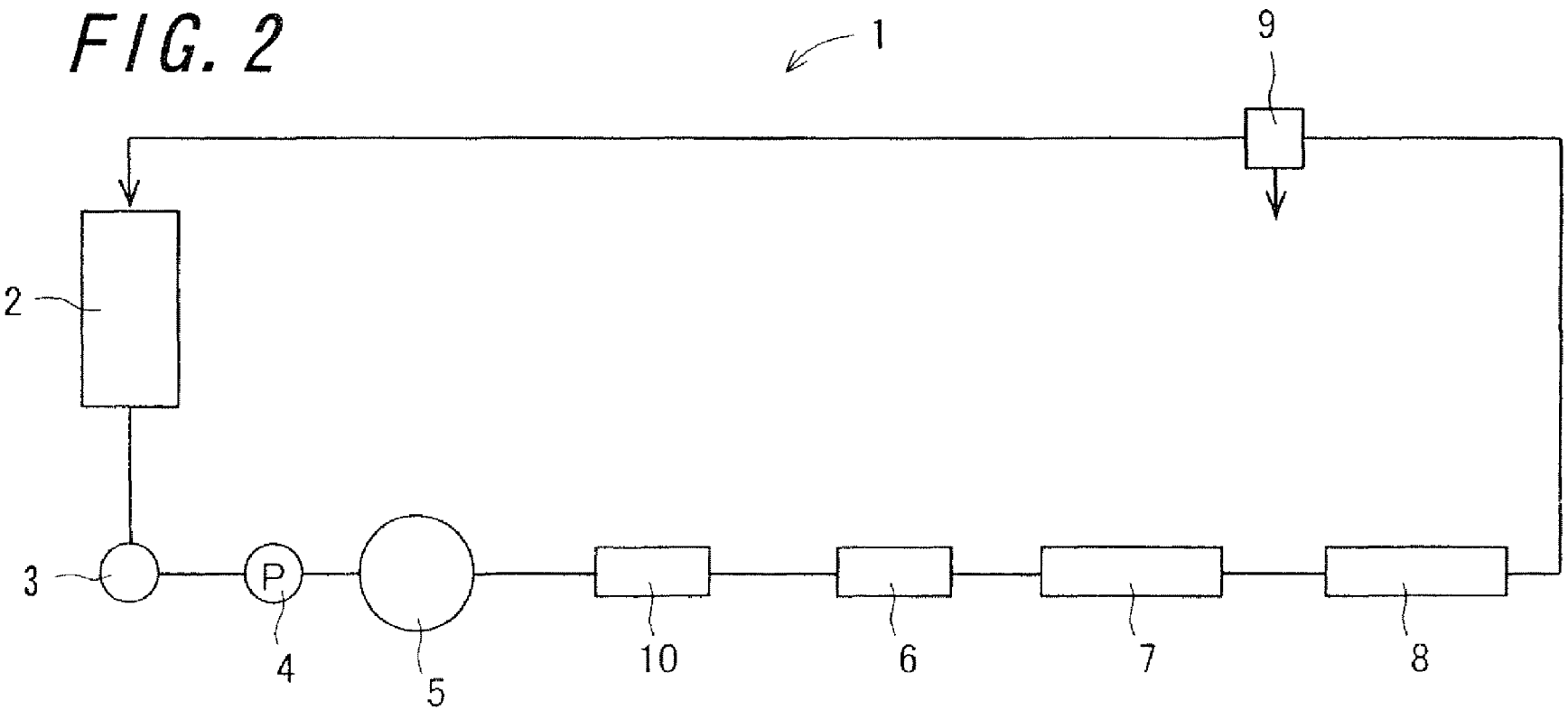
FIG. 2 is a system diagram schematically illustrating the constitution of the high-pressure homogenizer.

FIG. 2 is a system diagram schematically illustrating the constitution of the high-pressure homogenizer 1 which is constituted by a tank 2, a feed pump 3, a high-pressure pump 4, a heat exchanger 5, a nozzle 10, a first depressurizing module 6, a cooling unit 7, a second depressurizing module 8 and a take-out port 9 arranged in this order.

The coarse particle preparing step S1 and the slurry preparing step S2 are separately executed prior to throwing the slurry of fine resin particle into the high-pressure homogenizer 1. The slurry of fine resin particles is prepared by the slurry preparing step S2. The thus prepared slurry of fine resin particles is thrown into the high-pressure homogenizer 1 to form the aggregated particles.

The slurry of aggregated particles after the pressure is reduced through the second depressurizing module 8 may be taken out of the system through the take-cut port 9. Or, the slurry of aggregated particles after the pressure is reduced through the second depressurizing module 8 may be returned to the tank 2 again and may be repetitively circulated.

The aggregating step S3 is executed as the slurry of fine resin particles passes through the nozzle 10 and the first depressurizing module 6, the cooling step S4 is executed as the slurry of fine resin particles passes through the cooling unit 7, and the depressurizing step S5 is executed as the slurry of fine resin particles passes through the second depressurizing module 8.

The tank 2 is a container-like member having an internal space and stores the slurry of fine resin particles obtained through the slurry preparing step S2. The feed pump 3 feeds the slurry of fine resin particles stored in the tank 2 to the high-pressure pump 4. The high-pressure pump 4 pressurizes the slurry of fine resin particles fed from the feed pump 3 and feeds it to the heat exchanger 5. As the high-pressure pump 4, there can be used a plunger pump that includes a plunger and a pump that is driven by the plunger to take in and blow out. The heat exchanger 5 heats the slurry of fine resin particles in a pressurized state after having been fed from the high-pressure pump 4. The heat exchanger 5 includes, for example, a pipe for flowing the slurry of fine resin particles, a spiral pipe running along the surface of the pipe and in which a heat-exchanging medium flows, and a heating unit that is not shown. A heat medium heated by the heating unit flows through the spiral pipe to exchange the heat with the slurry of fine resin particles flowing through the pipe to thereby heat the slurry of fine resin particles. The heat medium-feeding unit is, for example, a boiler.

The first depressurizing module 6 permits the slurry of fine resin particles in the heated and pressurized state fed from the heat exchanger 5 to pass through the flow path formed therein enabling the fine resin particles to be aggregated and the pressure to be further reduced.

Figure 3:
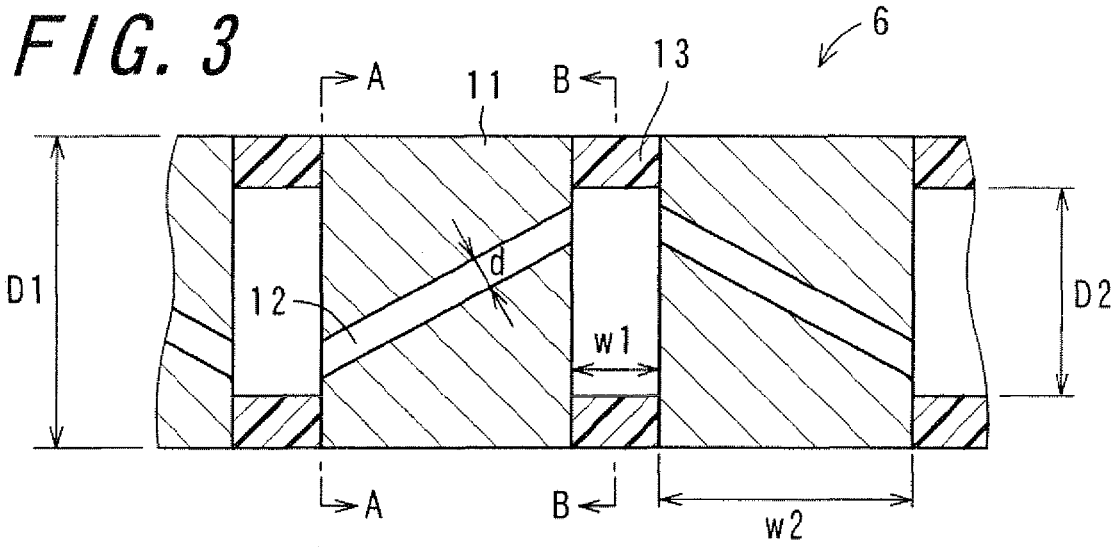
FIG. 3 is a sectional view schematically illustrating the constitution of the first depressurizing module in the longitudinal direction.
Figure 4A:
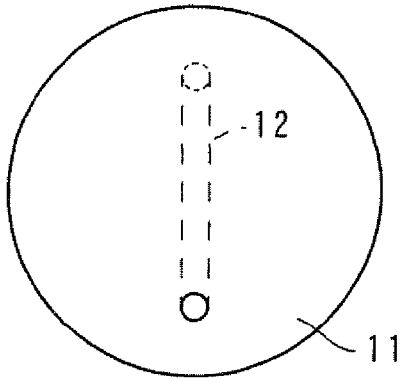
FIGS. 4A and 4B are sectional views of the first depressurizing module.
Figure 4B:
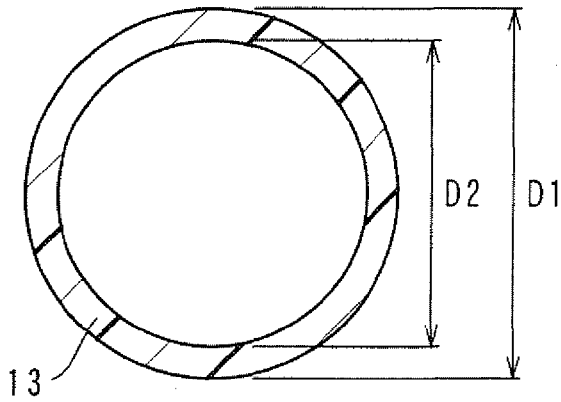

FIG. 3 is a sectional view schematically illustrating the constitution of the first depressurizing module 6 in the longitudinal direction. FIGS. 4A and 4B are sectional views of the first depressurizing module 6 perpendicular to the axis thereof, FIG. 4A being a sectional view taken along a line A-A in FIG. 3 and FIG. 4B being a sectional view taken along a line B-B in FIG. 3.

The first depressurizing module 6 is constituted by alternately stacking ring-like members 13 and cylindrical members 11 one upon the other in concentric. The cylindrical member 11 has a flow path 12 penetrating through in the axial direction and tilted with respect to the axis. Therefore, the slurry of fine resin particles that has flown into the first depressurizing module 6 passes through the internal space in the ring-like member 13 and the flow path 12 formed in the cylindrical member 11 alternately, whereby the fine resin particles are pulverized and aggregated, and the slurry as a whole passes with its pressure being reduced. The ring-like members 13 and the cylindrical members 11 are so stacked that the flow paths 12 formed in the cylindrical members 11 are symmetrically arranged holding the ring-like member 13 in between.

The ring-like member 13 has a thickness W1 which is about 1 mm in the axial direction while the cylindrical member 11 has a thickness W2 which is about 6 to 8 mm in the axial direction. Further, the ring-like member 13 and the cylindrical member 11 have an outer diameter D1 which is 5 mm while the ring-like member 13 has an inner diameter D2 which is 2.5 to 3 mm. The flow path 12 has a diameter d of 0.3 to 0.5 mm.

It is desired that the ring-like member 13 is constituted by using an engineering plastic such as PEEK (registered trademark). It is, further, desired that the cylindrical member 11 is made from ceramics and has the flow path 12 formed therein by punching.

Upon constituting the first depressurizing module 6 as described above, the directivity of the flow path in the depressurizing module can be controlled, making it possible to aggregate the fine particles and to adjust the particle size of the aggregated particles at the same time, as well as to decrease the manufacturing costs by simplifying the apparatus and decreasing the number of the steps. Further, the cylindrical member 11 constitutes a straight portion tilted with respect to the direction in which the aqueous slurry passes while the ring-like member 13 constitutes a portion for relaxing the flow of the aqueous slurry. Therefore, the flow that contributes to the aggregation and the flow that contributes to the atomization can be simultaneously created in the first depressurizing module 6 to thereby control the particle size of the aggregated particles. As a result, a toner is obtained having a sharp particle size distribution and a desired fine particle size.

The first depressurizing module 6 includes the ring-like members 13 and the cylindrical members 11 that are alternately contained in a cylindrical casing. By simply varying the numbers of the members, therefore, the length in the passing direction can be easily changed.

By increasing the length of the first depressurizing module 6, as described above, it is allowed to obtain the toner having more even particle sizes and particle size distribution.

As the cooling unit 7, a general liquid cooling unit can be used having a pressure resistant structure. For example, a cooling unit can be used having a pipe for circulating the cooling water surrounding a pipe through which the slurry passes in order to cool the slurry by circulating the cooling water. Particularly, a cooling unit is preferred having a large cooling area, such as a hose-type cooling unit. It is, further, desired that the cooling gradient decreases (or the cooling ability decreases) from the inlet of the cooling unit toward the outlet of the cooling unit. This more reliably prevents the pulverized fine resin particles from aggregating again. Therefore, the fine resin particles are atomized more efficiently contributing to increasing the yield of the fine resin particles. The cooling unit 7 may be provided in a number of one or in a plural number. When provided in a plural number, they may be provided in series or in parallel. When provided in series, it is desired that the cooling units are so provided that the cooling ability gradually decreases in a direction in which the slurry passes. The slurry that contains aggregated particles and is heated, is discharged from the first depressurizing module 6, is introduced into the cooling unit 7, for example, through an inlet port connected to the pipe of the cooling unit 7, cooled in the cooling unit 7 that has a cooling gradient, and is discharged from the outlet port of the cooling unit 7 into a pipe.

The second depressurizing module 8 can be provided with one or a plurality of multi-stage depressurizing devices or depressurizing nozzles. When provided in a plural number, they may be arranged in series or in parallel.

As the high-pressure homogenizer, NANO3000 (trade name, manufactured by Beryu Co., Ltd.) can be exemplified.

[Coarse Particle Preparing Step S1]

In this step, coarse particles of the synthetic resin are prepared. The synthetic resin may contain one or two or more of additives for the synthetic resin. The coarse particles of the synthetic resin can be manufactured by, for example, pulverizing the synthetic resin or, as required, a solidified product of a kneaded product of the synthetic resin and one or two or more of additives for the synthetic resin. The kneaded product is manufactured by, for example, dry-mixing the synthetic resin and, as required, one or two or more of additives for the synthetic resin by using a mixer, and by kneading the obtained powdery mixture by using a kneading machine. The temperature for mixing and kneading is not lower than the melting temperature of the bound resin and is, usually, about 80 to 200° C. and, preferably, about 100 to about 150° C. A known mixer can be used, like Henschel-type mixers such as HENSCHELMIXER (trade name, manufactured by Mitsui Mining Co., Ltd.), SUPERMIXER (trade name, manufactured by Kawata MFG Co., Ltd.) and MECHANOMIL (trade name, manufactured by Okada Seiko Co., Ltd.); as well as ANGMIL (trade name, manufactured by Hosokawa Micron Corporation), HYBRIDIZATION SYSTEM (trade name, manufactured by Nara machinery Co., Ltd.) and COSMOSYSTEM (trade name, manufactured by Kawasaki Heavy Industries, Ltd.) A known kneading machine can be used, such as a biaxial extruder, three-roll mill or a Laboplast mill, which has been generally used. More concretely, there can be used a monoaxial or biaxial extruder such as TEM-100B (trade name, manufactured by Toshiba machine Co., Ltd.) or PCM-65/87 (trade name, manufactured by Ikegai, Ltd.), or the one of the open roll system such as KNEADEX (trade name, manufactured by Mitsui mining Co., Ltd.) Among them, the kneading machine of the open roll system is preferred. Additives for the synthetic resin, such as coloring agents, may be used in the form of a masterbatch so as to be homogeneously dispersed in the kneaded product. Further, two or more of additives for the synthetic resin may be used in the form of composite particles. The composite particles can be manufactured by, for example, adding a suitable amount of water or a lower alcohol to two or more of additives for the synthetic resin, and granulating the mixture by using a general granulator such as high-speed mill followed by drying. The masterbatch and the composite particles are mixed into the powdery mixture at the time of dry-mixing.

The solidified product is obtained by cooling the kneaded product. The solidified product can be pulverized by using a powder pulverizer such as a cutter mill, a Feather mill or a jet mill. Coarse particles of the synthetic resin are thus obtained. Though there is no particular limitation, the particle size of the coarse particles is, preferably, 450 to 1,000 μm and, more preferably, 500 to 800 μm.

[Slurry Preparing Step S2]

In the slurry preparing step S2, the coarse particles of synthetic resin obtained in the coarse particle preparing step and a liquid are mixed together, and the coarse particles of synthetic resin are dispersed in the liquid to prepare a slurry of coarse particles. There is no particular limitation on the liquid to be mixed to the coarse particles of synthetic resin provided it does not dissolve the coarse particles of synthetic resin but is capable of homogeneously dispersing the coarse particles of synthetic resin therein. From the standpoint of easy control of the step, disposal of waste liquor after the whole steps and easy handling, however, water is desired and water containing a dispersant is more desired.

If a slurry of fine resin particles obtained by using an anionic dispersant that will be described below is directly used as a dispersant for the preparation of the aggregated particles, then the anionic dispersant does not have to be added in a pre-aggregating step in the method of manufacturing aggregated particles. Though there is no particular limitation, it is desired that the dispersant is added in an amount of 0.1 to 5% by weight and, more preferably, 0.1 to 3% by weight of the slurry of the coarse particles.

A thickener may be added together with the dispersing agent to the slurry of coarse particles. The thickener is effective in further fine granulation of the coarse particles. The thickener is desirably a polysaccharide type thickener selected from synthetic high molecular polysaccharides and natural high molecular polysaccharides. Known synthetic high molecular polysaccharides can be used, such as cationized cellulose, hydroxyethyl cellulose, starches, ionized starch derivatives and block polymer of starch and synthetic high molecules. As the natural high molecular polysaccharides, there can be exemplified hyaluronic acid, carrageenan, locust bean gum, xanthanegum, guar gum and gellan- gum. The thickeners may be used each alone or two or more of them may be used in combination. Though there is no particular limitation, it is desired that the thickener is used in an amount of 0.01 to 2% by weight of the whole amount of the slurry of the coarse particles.

The coarse synthetic resin powder and the liquid are mixed together by using a generally employed mixer to obtain the slurry of the coarse particles. There is no particular limitation on the amount of adding the coarse synthetic resin powder to the liquid. Preferably, however, the amount f the coarse synthetic resin powder is 3 to 45% by weight and, more preferably, 5 to 30% by weight based on the total amount of the coarse synthetic resin powder and the liquid. Further, the coarse synthetic resin powder and water are mixed together under heated or cooled condition but usually under room temperature condition. As the mixer, there can be exemplified ANGMIL (trade name, manufactured by Hosakawa Micron Corporation), HYBRIDIZATION SYSTEM (trade name, manufactured by Nara machinery Co., Ltd.) and COSMOSYSTEM (trade name, manufactured by Kawasaki Heavy Industries, Ltd.) The thus obtained slurry of coarse particles may be directly fed to the aggregating step S3, or may be pre-treated, e.g., subjected to the general pulverization treatment to pulverize the coarse synthetic resin powder to a particle size of, preferably, about 100 μm and, more preferably, not larger than 100 μm. The pulverization treatment which is the pretreatment is effected by treating the slurry of coarse particles by using, for example, a colloid mill.

[Aggregating Step S3]

In the aggregating step S3, the slurry of fine resin particles obtained through the slurry preparing step S2 is aggregated under a condition of an elevated temperature and a reduced pressure to obtain an aqueous slurry of aggregated particles. The aggregation is effected by using the first depressurizing module 6 in the high-pressure homogenizer 1. Though there is no particular limitation on the conditions for pressurizing and heating the slurry of fine resin particles, it is desired that the slurry at the inlet of the nozzle 10 is pressurized to 50 to 250 MPa and is heated at not lower than 50° C., more preferably, is pressured to 50 to 250 MPa and is heated at not lower than a melting point of the synthetic resin contained in the slurry of fine resin particles and, particularly preferably, is pressured to 50 to 250 MPa and is heated at the melting point to Tm+25° C. (Tm: one-half the softening temperature of the synthetic resin by using a flow tester) of the synthetic resin contained in the slurry of fine resin particles. Here, when the slurry of fine resin particles contains two or more of synthetic resins, the melting point of the synthetic resin and the one-half the softening temperature by using the flow tester are both the values of the synthetic resin having the highest melting point or the one-half softening temperature. If the pressure is lower than 50 MPa, the shearing energy becomes so small that the pulverization may not often be sufficiently effected. If the pressure exceeds 250 MPa, the probability of danger increases in the practical production line, which is not realistic. The slurry of fine resin particles is introduced into the nozzle 10 through the inlet of the nozzle 10 under a pressure and a temperature in the above-mentioned ranges. The aqueous slurry discharged from the outlet of the nozzle 10 for pulverization, for example, contains aggregated particles, and is heated at 60 to Tm+60° C. (Tm is as described above) and is pressurized to about 5 to about 50 MPa.

[Cooling Step S4]

In the cooling step S4, the aqueous slurry is cooled that contains the aggregated particles and has a liquid temperature of about 60 to Tm+60° C. (Tm is as described above) as it has passed through the aggregating step S3, whereby the slurry of about 20 to 30° C. is obtained. The cooling is effected by using the cooling unit 7 in the high-pressure homogenizer 1.

[Depressurizing Step S5]

In the depressurizing step S5, the aqueous slurry of aggregated particles obtained through the cooling step S4 is placed under a condition where the pressure is reduced to atmospheric pressure or a pressure close thereto. The pressure is reduced by using the second depressurizing module 8 in the high-pressure homogenizer 1.

the aqueous slurry after completion of the depressurizing step S5, for example, contains the aggregated particles and has a liquid temperature of about 60 to about Tm+60° C. In this specification, Tm stands for a softening temperature of the fine resin particles. In this specification, the softening temperature of the aggregated particles is measured by using an apparatus for evaluating the flow characteristics (trade name: Flow Tester CFT-100C, manufactured by Shimadzu corporation). The apparatus for evaluating the flow characteristics (Flow Tester CFT-100C) is so set that 1 g of a sample (fine resin particles) is extruded from a die (nozzle, port diameter of 1 mm, length of 1 mm) under a load of 10 kgf/cm$^2$ ($9.8\times10^5$ Pa). The sample is heated at a heating rate of 6° C. a minute, and the temperature is found at a moment when half the amount of the sample has flown from the die, and is regarded to be a softening temperature. Further, a glass transition temperature (Tg) of the synthetic resin can be found as described below. By using a differential scanning calorimeter (trade name: DSC 220, manufactured by Seiko Instruments & Electronics Ltd.), 1 g of the sample (carboxyl group-containing resin or water-soluble resin) is heated at a rate of 10° C. a minute to measure a DSC curve thereof in compliance with the Japanese Industrial Standards (JIS) K 7121-1987. The glass transition temperature (Tm) is found from a temperature at a point where a straight line drawn by extending a base line on the high temperature side of the endothermic peak corresponding to the glass transition of the obtained DSC curve toward the low temperature side, intersects a tangential line drawn at a point where the gradient becomes a maximum with respect to a curve from a rising portion of peak to a vertex.

Thus, an aqueous slurry is obtained containing aggregated particles. The aqueous slurry can be directly used for the manufacturing of toner particles. The aggregated particles may be isolated from the aqueous slurry, and from which a slurry may be newly prepared so as to be used as a starting material of the aggregated particles. The aggregated particles can be isolated from the aqueous slurry by using a generally employed separation unit such as filtration or centrifuge.

In this manufacturing method, the particle size of the obtained aggregated particles is controlled by suitably adjusting the temperature and/or pressure imparted to the aqueous slurry, as well as the concentration of coarse particles in the aqueous slurry and the number of times of pulverization at the time of passing the aqueous slurry through the first depressurizing module 6.

In this specification, the volume average particle size and the coefficient of variation (CV value) are found as described below. To 50 ml of an electrolyte (trade name: ISOTON-II, manufactured by Beckman Coulter Inc.), there are added 20 mg of a sample and 1 ml of a sodium alkyl ether sulfate followed by dispersion treatment at an ultrasonic wave frequency of 20 kHz for 3 minutes by using an ultrasonic wave dispersion device (trade name: UH-50, manufactured by STM Corporation) to prepare a sample for measurement. By using a particle size distribution-measuring device (trade name: Multisizer 3, manufactured by Beckman Coulter Inc.), the sample for measurement is measured under the conditions of an aperture diameter of 20 μm and a number of particles to be measured: 50,000 counts. A volume average particle size is found from the volume particle size distribution of the sample particles, and a standard deviation Is found in the volume particle size distribution. The coefficient of variation (CV %) is calculated based on the following formula, CV value (%)=(Standard deviation in the volume particle size distribution/volume average particle size)×100

[Aggregated Particles]

The aggregated particles are the fine particles obtained by the above-mentioned manufacturing method and are, preferably, controlled for their particle size so as to assume a volume average particle size of 5 to 6 μm. When used as the toner, the aggregated particles having the volume average particle size of 5 to 6 μm exhibit excellent preservation stability under heated condition such as in a developing tank, and make it possible to stably form images of high quality without defect maintaining high density, high degree of fineness and favorable reproduceability.

Upon adding a metal salt, the slurry of fine resin particles is salted out and aggregated. Addition of the metal salt decreases the dispersion of the fine resin particles in the slurry of fine resin particles. As the slurry of fine resin particles pass through the depressurizing module in this state, the fine resin particles are smoothly aggregated flawlessly, and aggregated particles are obtained having little dispersion in the shape and in the particle size. As the metal salt, there can be used one or two or more selected from potassium chloride, sodium chloride, calcium chloride, magnesium chloride and aluminum chloride.

The amount of addition of the metal salt can be suitably selected from a wide range without any particular limitation. Preferably, however, the metal salt is added in an amount of 0.1 to 5% by weight of the whole amount of the slurry of fine resin particles. If the amount of addition is smaller than 0.1% by weight, the ability for weakening the dispersion of the fine resin particles is not sufficient, and the fine resin particles may not be sufficiently aggregated. If the amount of addition exceeds 5% by weight, excess aggregation occurs.

It is desired to add an anionic dispersant to the slurry of fine resin particles. When the synthetic resin which is the matrix component of the fine resin particles is a resin which is not a self-dispersion type resin, it is desired to add the anionic dispersant to the slurry of fine resin particles. The anionic dispersant improves the dispersion of fine resin particles in water. Therefore, the anionic dispersant is added to the slurry of fine resin particles and, besides, a cationic dispersant is added thereto enabling the fine resin particles to be smoothly aggregated while preventing the occurrence of excess aggregation and making it possible to manufacture aggregated particles having a narrow particle size distribution in good yield. The anionic dispersant may be added to the slurry of coarse particles in the stage of preparing the slurry of coarse particles. A known anionic dispersant can be used, such as sulfonic acid anionic dispersant, sulfuric acid ester anionic dispersant, polyoxyethylene ether anionic dispersant, phosphoric acid ester anionic dispersant or polyacrylate. Concrete examples of the anionic dispersant include sodium dodecylbenzene sulfonate, sodium polyacrylate, and polyoxyethylenephenyl ether. The anionic dispersants may be used each alone or two or more of them may be used in combination. Though there is no particular limitation, the amount of adding the anionic dispersant is, preferably 0.1 to 5% by weight of the whole amount of the slurry of fine resin particles. It the amount is smaller than 0.1% by weight, the effect of the anionic dispersant for dispersing the fine resin particles is not sufficient and excess aggregation may occur. Even if the addition exceeds 5% by weight, on the other hand, the effect of dispersion is not so improved but rather the viscosity of the slurry of fine resin particles increases and the dispersion of the fine resin particles decreases. As a result, excess aggregation may occur.

The slurry of fine resin particles is heated, preferably, at a glass transition temperature of the fine resin particles to a softening temperature (° C.) of the fine resin particles, more preferably, to 60 to 90° C., and is pressurized, preferably, to 5 to 100 MPa and, more preferably, 5 to 20 MPa. If the heating temperature is lower than the glass transition temperature of the fine resin particles, the fine resin particles are little aggregated and the yield of the aggregated particles may decrease. If the heating temperature exceeds the softening temperature of the fine resin particles, excess aggregation takes place making it difficult to control the particle size. If the pressure is lower than 5 MPa, the slurry of fine resin particles cannot smoothly pass through the coiled pipe. If the applied pressure exceeds 100 MPa, the fine resin particles aggregate very little.

When the thus manufactured aggregated particles are used as a toner, there may be further mixed external additives having functions for improving powder fluidity, friction electric charging property, heat resistance, long-term preservation property, cleaning property and for controlling photoreceptor surface abrasion property. As the external additives, there can be used, for example, a fine silica powder, a fine silica powder of which the surfaces are treated with a silicone resin or a silane coupling agent, a fine titanium oxide powder and a fine alumina powder. The external additives may be used each alone or two or more of them may be used in combination. It is desired that the external additives are added in an amount of not less than 0.1 part by weight but not more than 10 parts by weight based on 100 parts by weight of the toner particles by taking into consideration the amount of electric charge necessary for the toner, effect of the external additives on the abrasion of the photoreceptor and environmental properties of the toner.

The thus manufactured toner of the invention can be used for developing electrostatic charge images of when images are formed by an electrophographic method or an electrostatic recording method, and for developing magnetic latent images of when images are formed by a magnetic recording method. The toner can be further used as a one-component developer or a two-component developer.

When the toner is used as the one-component developer, no carrier is used. That is, the aggregated particles only are used, a blade and a fur brush are used, the toner is frictionally charged with a developing sleeve so that the aggregated particles adhere on the sleeve and are conveyed to form an image.

The two-component developer of the invention contains the above-mentioned toner and carrier. Namely, the two-component developer is obtained without lowering the durability of the toner yet suppressing environmental contamination. Further, the two-component developer contains the above-mentioned toner which is highly transparent and can be applied to a color toner, too, i.e., a two-component developer is obtained that is capable of forming images of highly transparent and high quality.

As the carrier, magnetic particles can be used. Concrete examples of the magnetic particles include metals such as iron, ferrite and magnetite, as well as alloys of these metals and such a metal as aluminum or lead. Among them, ferrite is preferred, such as ferrite containing one or two or more selected from iron, copper, zinc, nickel, cobalt, manganese and chromium. There can be, further, used a coated carrier obtained by coating magnetic particles with a coating material or a resin dispersion carrier obtained by dispersing magnetic particles in a resin. As the material of the coating, there can be used, for example, polytetrafluoroethylene, monochlorotrifluoroethylene polymer, polyvinylidene fluoride, silicone resin, polyester, metal salt of di-tert-butylsalicylic acid, olefin resin, styrene resin, acrylic resin, styrene/acrylic resin, ester resin, fluorine-contained polymer resin, polyacid, polyvinylbutyral, nigrosine, aminoacrylate resin, basic dye, lake product of basic dye, silica powder and alumina powder. The material of the coating can be suitably selected depending upon the component contained in the aggregated particles. The coating materials can be used each alone or two or more of them may be used in combination. Though there is no particular limitation, the resin used for the resin dispersion carrier may be, for example, styrene acrylic resin, polyester resin, fluorine-contained resin or phenol resin.

It is desired that the carrier has a spherical shape or a flat shape. Though there is no particular limitation, it is desired that the carrier has a volume average particle size of, not smaller than 10 μm but not larger than 100 μm and, more preferably, not smaller than 20 μm but not larger than 50 μm by taking high image quality into consideration. Moreover, it is desired that the carrier resistivity is, not smaller than $10^8$ Ω·cm and, more preferably, not smaller than $10^{12}$ Ω·cm. The resistivity of the carrier is found by introducing the carrier into a container having a sectional area of 0.50 $cm^2$, tapping the container, exerting a load of 1 $kg/cm^2$ on the particles packed in the container, applying a voltage across the load and the bottom surface electrode so as to establish an electric field of 1000V/cm, and reading an electric current that flows at this moment. If the resistivity is low, an electric charge is poured into the carrier when a bias voltage is applied to a developing sleeve, and the carrier particles tend to adhere on the photoreceptor. Besides, the bias voltage easily breaks down.

The intensity of magnetization (maximum magnetization) of the carrier is, preferably, not smaller than 10 emu/g but not larger than 60 emu/g and, more preferably, not smaller than 15 emu/g but not larger than 40 emu/g. The intensity of magnetization may vary depending upon the magnetic flux density of the developing roller. Under the conditions of a general magnetic flux density of a developing roller, however, if the intensity of magnetization is smaller than 10 emu/g, no magnetic binding force works and the carrier tends to scatter. Further, if the intensity of magnetization exceeds 60 emu/g, it becomes difficult to maintain the state of not contacting to the image carrier in the non-contact developing in which the ear of the carrier becomes too high. In the contact developing, sweeping stripes may easily appear on the toner image.

There is no particular limitation on the ratio of using the toner and the carrier in the two-component developer, and the ratio can be suitably selected depending upon the toner and the carrier. In the case of the ferrite carrier, for example, the toner may be used in an amount of not less than 2% by weight but not more than 30% by weight and, preferably, not less than 2% by weight but not more than 20% by weight based on the whole amount of the developer. In the two-component developer, further, the ratio of covering carrier with the toner is desirably not less than 40% by weight but not more than 80% by weight.

Upon containing the toner of the invention and the above-mentioned carrier, the two-component developer of the invention does not permit the wax to bleed out and, therefore, does not form filming on the photoreceptor or does not develop offset phenomenon in a high temperature zone, making it possible to form highly fine images having high resolution and high quality.

Figure 5:
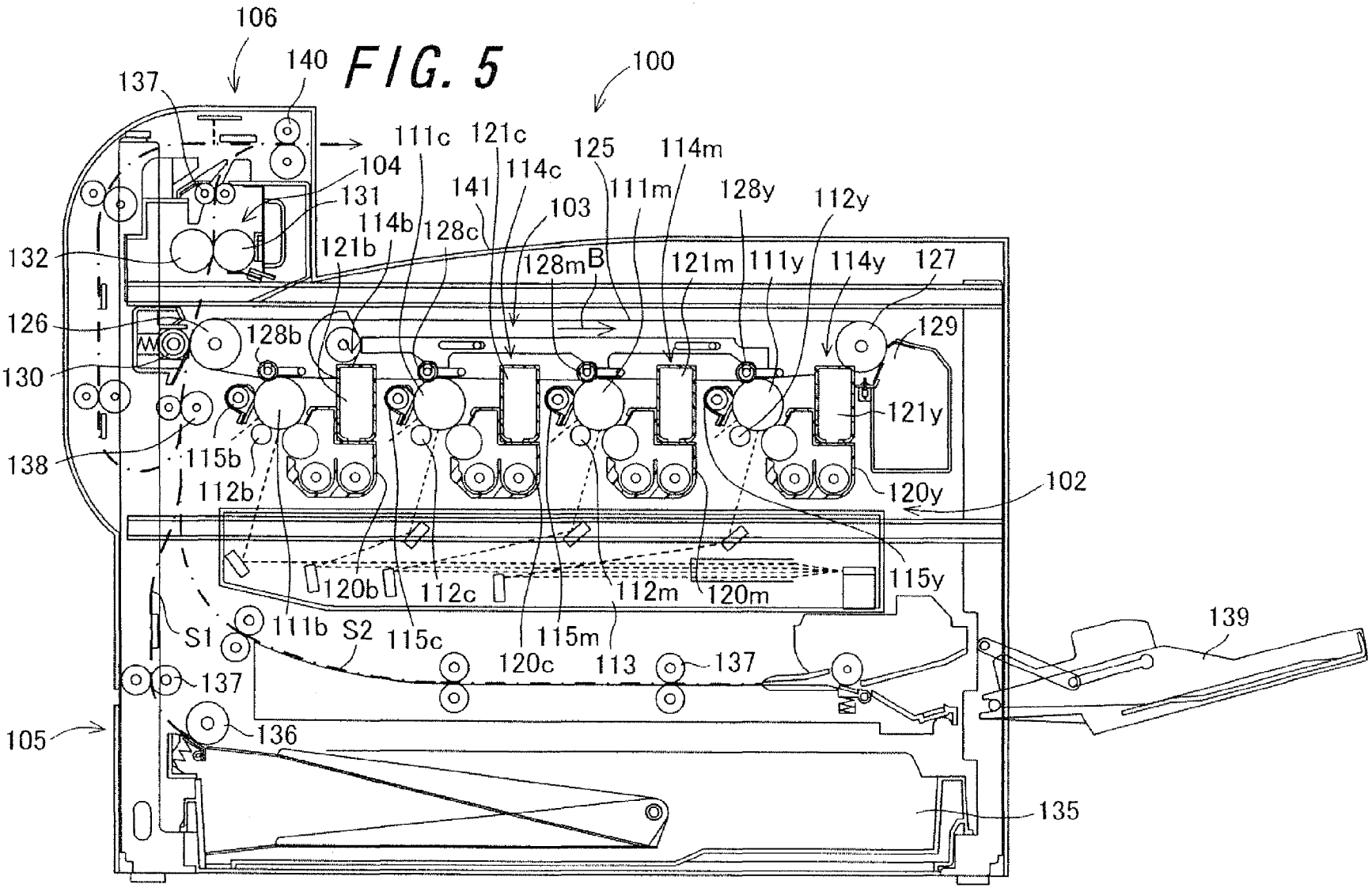
FIG. 5 is a sectional view illustrating the constitution of an image forming apparatus according to an embodiment of the invention.

FIG. 5 is a sectional view illustrating the constitution of an image forming apparatus 100 according to an embodiment of the invention. The image forming apparatus 100 includes a developing device 114 for effecting the developing by using the above-mentioned two-component developer. Therefore, the developing device 114 forms a toner image of high quality on a photoreceptor drum 111 and, therefore, forms a highly transparent image of high quality while suppressing environmental contamination. The image forming apparatus 100 is a multi-function peripheral having a copier function, a printer function and a facsimile function in combination, and forms a full-color or monochromatic image on a recording medium depending upon the transmitted image data. That is, the image forming apparatus has three kinds of printing modes, i.e., copier mode (reproduction mode), printer mode and facsimile mode and in which a control unit (not shown) selects a printing mode depending upon the reception of an input through an operation portion (not shown), or a print job from a personal computer, a portable terminal device, an information storage medium or external equipment using a memory. The image forming apparatus includes a toner image forming section 102, a transfer section 103, a fixing section 104, a recording medium feeding section 105 and a discharge section 106. The members constituting the toner image forming section 102 and some of the members included in the transfer section 103 are each constituted in a number of four to cope with image data of such colors as black (b), cyan (c), magenta (m) and yellow (y) included in the color image data. Here, the members each provided in a number of four to meet the colors take alphabets representing colors at the ends of the reference numerals so as to be distinguished, and take reference numerals only when they are to be collectively referred to.

The toner image forming section 102 includes a photoreceptor drum 111, a charging section 112, an exposure unit 113, a developing device 114 and a cleaning unit 115. The charging section 112, developing device 114 and cleaning unit 115 are arranged in this order in a direction in which the photoreceptor drum 111 rotates. The charging section 112 is arranged under the developing device 114 and the cleaning unit 115 in a vertical direction.

The photoreceptor drum 111 is supported by a drive portion (not shown) so as to be driven to rotate about the axis thereof, and includes a conductive substrate and a photosensitive layer formed on the surface of the conductive substrate, that are not shown. The conductive substrate can assume various forms, such as a cylinder, a column or a thin sheet. Among them, the cylinder is preferred. The conductive substrate is formed by using a conductive material. The conductive material may be the one that is usually used in this field of art, such as a metal like aluminum, copper, brass, zinc, nickel, stainless steel, chromium, molybdenum, vanadium, indium, titanium, gold or platinum, an alloy of two or more of the above-mentioned metals, a conductive film obtained by forming a conductive layer of one or two or more selected from aluminum, aluminum alloy, tin oxide, gold and indium oxide on a film-like base material such as synthetic resin film, metal film or paper, or a resin composition containing conductive particles and/or a conductive polymer. As the film-like base material used for the conductive film, a synthetic resin film is preferred and a polyester film is particularly preferred. The conductive layer is formed on the conductive film by, preferably, vacuum evaporation or by being applied thereon.

The photosensitive layer is formed by, for example, laminating a charge generating layer containing a charge generating substance and a charge transporting layer containing a charge transporting substance. Here, an undercoat layer is desirably provided between the conductive substrate and the charge generating layer or the charge transporting layer. The undercoat layer covers scars and asperities on the surface of the conductive substrate, and offers such advantages as smoothing the surface of the photosensitive layer, preventing the charging property of the photosensitive layer from deteriorating after the repetitive use, and improving charging characteristics of the photosensitive layer in a low-temperature and/or a low-humidity environment. Further, a photoreceptor surface protection layer may be provided as the uppermost layer to obtain a layered photoreceptor of a three-layer structure having increased durability The charge generating layer contains, as a chief component, the charge generating substance that generates the electric charge upon being irradiated with light and may, further, contain a known binder resin, a plasticizer and a sensitizer, as required. The charge generating substance may be the one that is usually used in this field, and there can be used perillene pigments such as perilleneimide and anhydrous perylenic acid; polycyclic quinone pigments such as quinacridone and anthraquinone; phthalocyanine pigments such as metal and metal-free phthalocyanines and halogenated metal-free phthalocyanine; and azo pigments having squarium pigment, azulenium pigment, thiapyrylium pigment, carbazole skeleton, styrylstylbene sleketon, triphenylamine skeleton, dibenzothiophene skeleton, oxadiazole skeleton, fluorenone skeleton, bisstylbene skeleton, distyryloxadiazole skeleton or distyrylcarbazole skeleton. Among them, the metal-free phthalocyanine pigment, oxotitanylphthalocyanine pigment, bisazo pigment containing a fluorene ring and/or a fluorenone ring, bisazo pigment comprising an aromatic amine and trisazo pigment, have high charge-generating capability and are suited for obtaining a highly sensitive photosensitive layer. The charge generating substances may be used each alone or two or more of them may be used in combination. Though there is no particular limitation, the charge generating substance can be contained in an amount of, preferably, 5 to 500 parts by weight and, more preferably, 10 to 200 parts by weight based on 100 parts by weight of the binder resin in the charge generating layer. The binder resin used for the charge generating layer may be the one that is usually used in this field of art, such as melamine resin, epoxy resin, silicone resin, polyurethane, acrylic resin, vinyl chloride/vinyl acetate copolymer resin, polycarbonate, phenoxy resin, polyvinyl butyral, polyarylate, polyamide and polyester. The binder resins may be used each alone or, as required, two or more of them may be used in combination.

The charge generating layer can be formed by preparing a coating solution for charge generating layer by dissolving or dispersing the charge generating substance, binder resin and, as required, plasticizer and sensitizer in suitable amounts in a suitable organic solvent capable of dissolving or dispersing these components, and applying the coating solution for charge generating layer onto the surface of the conductive substrate, followed by drying. Though there is no particular limitation, the thus obtained charge generating layer has a thickness of, preferably, 0.05 to 5 μm and, more preferably, 0.1 to 2.5 μm.

The charge transporting layer laminated on the charge generating layer contains the charge transporting substance capable of receiving and transporting the electric charge generated by the charge generating substance and the binder resin for the charge transporting layer as essential components and, further, contains, as required, a known antioxidizing agent, plasticizer, sensitizer and lubricant. The charge transporting substance may be the one that is usually used in this field of art, and there can be used electron-donating materials such as poly-N-vinylcarbazole and derivatives thereof, poly-γ-carbazolylethyl glutamate and derivatives thereof, pyrene/formaldehyde condensate and derivatives thereof, polyvinylpyrene, polyvinylphenanthrene, oxazole derivative, oxadiazole derivative, imidazole derivative, 9-(p-diethylaminostyryl)anthracene, 1,1-bis(4-dibenzylaminophenyl)propane, styrylanthracene, styrylpyrazoline, pyrazoline derivative, phenylhydrazones, hydrazone derivative, triphenylamine compound, tetraphenyldiamine compound, triphenylmethane compound, stylbene compound and azine compound having a 3-methyl-2-benzothiazoline ring; and electron-accepting materials, such as fluorenone derivative, dibenzothiophene derivative, indenothiophene derivative, phenanthrenequinone derivative, indenopyridine derivative, thioxanthone derivative, benzo[c]cinnoline derivative, phenadineoxide derivative, tetracyanoethylene, tetracyanoquinodimethane, bromanil, chloranil and benzoquinone. The charge transporting substances may be used each alone or two or more of them may be used in combination. Though there is no particular limitation, the charge transporting substance can be contained in an amount of 10 to 300 parts by weight and, more preferably, 30 to 150 parts by weight based on 100 parts by weight of the binder resin in the charge transporting layer. The binder resin used for the charge transporting layer may be the one that is usually used in this field of art and that is capable of homogeneously dispersing the charge transporting substance therein. There can be used, for example, polycarbonate, polyarylate, polyvinyl butyral, polyamide, polyester, polyketone, epoxy resin, polyurethane, polyvinyl ketone, polystyrene, polyacrylamide, phenol resin, phenoxy resin, polysulfone resin or copolymer resin thereof. Among them, it is desired to use polycarbonate containing bisphenol Z as a monomer component (hereinafter referred to as bisphenol Z-type polycarbonate) or a mixture of the bisphenol Z-type polycarbonate and other polycarbonates from the standpoint of film-forming property, wear resistance of the obtained charge transporting layer and electric properties. The binder resins can be used each alone or two or more of them may be used in combination.

It is desired that the charge transporting layer contains an antioxidizing agent together with the charge transporting substance and the binder resin for the charge transporting layer. The antioxidizing agent may be the one usually used in this field of art, such as vitamin E, hydroquinone, hindered amine, hindered phenol, paraphenylenediamine, arylalkane and derivatives thereof, organosulfur compound and organophosphor compound. The antioxidizing agents may be used each alone or two or more of them may be used in combination. Though there is no particular limitation, the content of the antioxidizing agent is 0.01 to 10% by weight and, preferably, 0.05 to 5% by weight based on the total amount of the components constituting the charge transporting layer. The charge transporting layer can be formed by preparing a coating solution for charge transporting layer by dissolving or dispersing the charge transporting substance, binder resin and, as required, antioxidizing agent, plasticizer and sensitizer in suitable amounts in a suitable organic solvent capable of dissolving or dispersing these components, and applying the coating solution for charge transporting layer onto the surface of the charge generating layer, followed by drying. Though there is no particular limitation, the thus obtained charge transporting layer has a thickness of, preferably, 10 to 50 μm and, more preferably, 15 to 40 μm. Here, the photosensitive layer can also be formed by making the charge generating substance and the charge transporting substance present in one layer. In this case, the kinds and contents of the charge generating substance and of the charge transporting material, the binder resin and other additives may be the same as those of when the charge generating layer and the charge transporting layer are separately formed.

This embodiment employs the photoreceptor drum that forms the organic photosensitive layer by using the charge generating substance and the charge transporting substance. It is, however, also allowable to employ the photoreceptor drum that forms the inorganic photosensitive layer by using silicon and the like.

The charging section 112 faces the photoreceptor drum 111, is arranged along the longitudinal direction of the photoreceptor drum 111 maintaining a gap from the surface of the photoreceptor drum 111, and electrically charges the surface of the photoreceptor drum 111 into a predetermined polarity and potential. As the charging section 112, there can be used a charging brush-type charger, a charger-type charger, a pin array charger or an ion generator. In this embodiment, the charging section 112 is provided being separated away from the surface of the photoreceptor drum 111, to which only, however, the invention is not limited. For example, a charging roller may be used as the charging section 112 and may be so arranged as to come in pressure-contact with the photoreceptor drum. Or, there may be used a charger of the contact charging type, such as a charging brush or a magnetic brush.

The exposure unit 113 is so arranged that light corresponding to the respective pieces of color information from the exposure unit 113 passes through between the charging section 112 and the developing device 114, and falls on the surface of the photoreceptor drum 111. The exposure unit 113 converts the image information into light corresponding to the respective pieces of color information b, c, m and y in the unit, and exposes the surface of the photoreceptor drum 111 charged to uniform potential by the charging means 112 to light corresponding to the respective pieces of color information to form electrostatic latent image on the surfaces. As the exposure unit 113, there can be used a laser scanning unit having a laser irradiation portion and a plurality of reflectors. There can be, further, used a unit which is suitably combined with an LED (light emitting diode) array, a liquid crystal shutter and a source of light.

Figure 6:
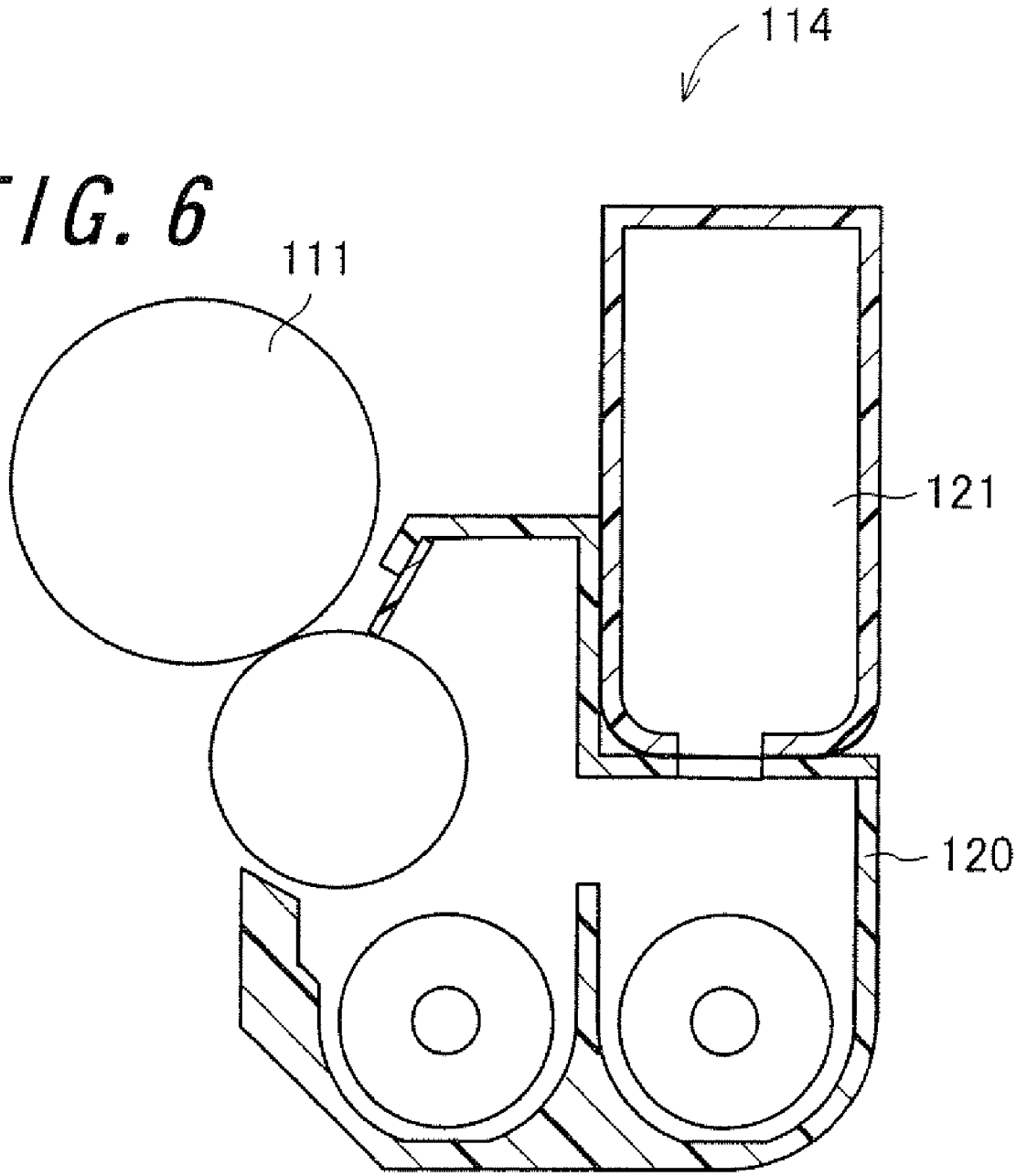
FIG. 6 is a view showing the constitution of a developing device of the invention.

FIG. 6 is a view showing the constitution of the developing device 114 of the invention. The developing device 114 includes a developing tank 120 and a toner hopper 121. The developing tank 120 is a container member which is so arranged as to face the surface of the photoreceptor drum 111, feeds the toner to the electrostatic latent image formed on the surface of the photoreceptor drum 111 to develop it to thereby form a toner image which is a visible image. The developing tank 120 contains the toner in the inner space thereof, and contains roller members such as a developing roller, a feed roller and a stirrer roller, or screw members, and rotatably supports them. An opening portion is formed in the side surface of the developing tank 120 facing the photoreceptor drum 111, and the developing roller is rotatably provided at a position where it faces the photoreceptor drum 111 via the opening portion. The developing roller is a roller member that feeds the toner to the electrostatic latent image on the surface of the photoreceptor drum 111 at a position where the developing roller is in pressure-contact with, or is the closest to, the photoreceptor drum 111. In feeding the toner, a potential of a polarity opposite to the charged potential of the toner is applied to the surface of the developing roller as the developing bias voltage. Therefore, the toner on the surface of the developing roller is smoothly fed to the electrostatic latent image. By varying the developing bias voltage value, further, the amount of toner (toner attachment amount) fed to the electrostatic latent image can be controlled. The feed roller is a roller member rotatably provided facing the developing roller, and feeds the toner to the periphery of the developing roller. The stirrer roller is a roller member rotatably provided facing the feed roller, and feeds, to the periphery of the feed roller, the toner that is newly fed into the developing tank 120 from the toner hopper 121. The toner hopper 121 is so provided that a toner replenishing port (not shown) provided at a lower portion thereof in the vertical direction is communicated with a toner receiving port (not shown) formed in the upper part of the developing tank 120 in the vertical direction, and works to replenish the toner depending upon the consumption of toner in the developing tank 120. Instead of using the toner hopper 121, it is also allowable to directly replenish the toner from the toner cartridges of various colors.

After the toner image is transferred onto the recording medium, the cleaning unit 115 removes the toner remaining on the surface of the photoreceptor drum 111, and cleans the surface of the photoreceptor drum 111. As the cleaning unit 115, a plate-like member is used, such as a cleaning blade. In the image forming apparatus of the invention, an organic photoreceptor drum is chiefly used as the photoreceptor drum 111. The surface of the organic photoreceptor drum chiefly comprises a resin component, and undergoes the deterioration due to the chemical action of ozone generated by the corona discharge of the charging device. Here, however, the deteriorated surface is abraded being rubbed by the cleaning unit 115, and is reliably removed though gradually. Therefore, the problem of deterioration of the surface due to ozone is virtually eliminated, and the potential due to the charging operation can be stably maintained over extended periods of time. The cleaning unit 115 is provided in this embodiment. Without being limited thereto, however, the cleaning unit 115 may not be provided.

In the toner image forming section 102, the surface of the photoreceptor drum 111 which is being uniformly charged by the charging section 112 is irradiated with signal beams corresponding to image data from the exposure unit 113 to form an electrostatic latent image, the toner is fed thereto from the developing device 114 to form a toner image which is, then, transferred onto an intermediate transfer belt 125. Thereafter, the toner remaining on the surface of the photoreceptor drum 111 is removed by the cleaning unit 115. The above-mentioned series of toner image forming operations is repetitively executed.

The transfer section 103 is arranged over the photoreceptor drum 111, and includes an intermediate transfer belt 125, a drive roller 126, a driven roller 127, intermediate transfer rollers 128 (b, c, m, y), a transfer belt cleaning unit 129, and a transfer roller 130. The intermediate transfer belt 125 is an endless belt member stretched between the driver roller 126 and the driven roller 127, and forms a loop-like moving path, and rotates in the direction of an arrow B. While the intermediate transfer belt 125 passes by the photoreceptor drum 111 in contact with the photoreceptor drum 111, the intermediate transfer roller 128 arranged facing the photoreceptor drum 111 via the intermediate transfer belt 125 applies a transfer bias voltage of a polarity opposite to the polarity of charge of the toner on the surface of the photoreceptor drum 111, and the toner image formed on the surface of the photoreceptor drum 111 is transferred onto the intermediate transfer belt 125. In the case of the full-color image, toner images of various colors formed by the photoreceptor drums 111 are successively transferred and overlaid onto the intermediate transfer belt 125 one upon the other, and the full-color toner image is formed. The drive roller 126 is rotatably provided so as to rotate about the axis thereof being driven by a drive portion (not shown) and due to its rotation, the intermediate transfer belt 125 is driven in the direction of the arrow B. The driven roller 127 is rotatably provided so as to rotate following the rotation of the drive roller 126, and imparts a predetermined tension to the intermediate transfer belt 125 to prevent the intermediate transfer belt 125 from being slackened. The intermediate transfer roller 128 is rotatably provided to come into pressure-contact with the photoreceptor drum 111 via the intermediate transfer belt 125, and is driven by a drive portion (not shown) so as to rotate about the axis thereof. The intermediate transfer roller 128 is connected to a power source (not shown) for applying the transfer bias as described above, and has a function for transferring the toner image on the surface of the photoreceptor drum 111 onto the intermediate transfer belt 125. The transfer belt cleaning unit 129 faces the driven roller 127 via the intermediate transfer belt 125, and comes in contact with the outer peripheral surface of the intermediate transfer belt 125. The toner that adheres to the intermediate transfer belt 125 due to the contact with the photoreceptor drum 111 becomes a cause of contaminating the back surface of the recording medium. Therefore, the transfer belt cleaning unit 129 recovers the toner by removing it from the surface of the intermediate transfer belt 125. The transfer roller 130 is rotatably provided to come into pressure-contact with the drive roller 126 the intermediate transfer belt 125, and is driven by a drive portion (not shown) so as to rotate about the axis thereof. At the pressure-contact portion (transfer nip portion) between the transfer roller 130 and the drive roller 126, the toner image conveyed while being borne on the intermediate transfer belt 125 is transferred onto the recording medium fed from a recording medium feed section 105 that will be described later. The recording medium bearing the toner image thereon is fed to the fixing section 104. In the transfer section 103, the toner image is transferred from the photoreceptor drum 111 onto the intermediate transfer belt 125 at the pressure-contact portion between the photoreceptor drum 111 and the intermediate transfer roller 128, conveyed to the transfer nip portion as the intermediate transfer belt 125 is driven in the direction of the arrow B, and is transferred onto the recording medium.

The fixing section 104 is provided downstream of the transfer section 103 in the direction in which the recording medium is conveyed, and includes a fixing roller 131 and a pressure roller 132. The fixing roller 131 is provided so as to be rotated by being driven by a drive portion (not shown), and heats and melts the toner that constitutes the unfixed toner image borne on the recording medium to thereby fix it to the recording medium. The fixing roller 131 contains therein a heating portion (not shown). The heating portion so heats the fixing roller 131 that the surface of the fixing roller 131 assumes a predetermined temperature (heating temperature). As the heating portion, there can be used, for example, a heater or a halogen lamp. The heating portion is controlled by a fixing condition control portion. A temperature detector is provided near the surface of the fixing roller 131 to detect the surface temperature of the fixing roller 131. The result detected by the temperature detector is written into a memory portion of a control unit described later. The pressure roller 132 is provided to be in pressure-contact with the fixing roller 131 and is driven by the rotation of the fixing roller 131. At the time when the toner is fused and is fixed to the recording medium by the fixing roller 131, the pressure roller 132 presses the toner and the recording medium to assist the fixing of the toner image on the recording medium. The pressure-contact portion between the fixing roller 131 and the pressure roller 32 is a fix nip portion. In the fixing section 104, the recording medium to which the toner image is transferred in the transfer section 103 is held by the fixing roller 131 and the pressure roller 132, and passes through the fix nip portion whereby the toner image is pressed onto the recording medium under a heated condition and the toner image is fixed onto the recording medium to form the image.

The recording medium feeding section 105 includes an automatic paper feed tray 135, a pickup roller 136, conveying rollers 137, registration rollers 138, a manual paper feed tray 139. The automatic paper feed tray 135 is a container-like member disposed below the image forming apparatus in the vertical direction and stores the recording mediums. Examples of he recording mediums include plain paper, color copy paper, sheets for overhead projector use, and postcards. The pickup roller 136 takes out recording mediums stored in the automatic paper feed tray 135 one by one and feeds each recording medium to a paper conveyance path S1. The conveying rollers 137 are a pair of roller members disposed so as to be in pressure-contact with each other and convey the recording medium to the registration rollers 138. The registration rollers 138 are a pair of roller members disposed so as to be in pressure-contact with each other and feed the recording medium fed from the conveying rollers 137 to the transfer nip portion in synchronization with the conveying of toner images borne on the intermediate transfer belt 125 to the transfer nip portion. The manual paper feed tray 139 is a device storing recording mediums which are different from the recording mediums stored in the automatic paper feed tray 135 and may have any size and which are to be taken into the image forming apparatus. The recording medium taken in from the manual paper feed tray 139 is made to pass through a paper conveyance path S2 by means of the conveying rollers 137 and fed to the registration rollers 138. The recording medium feeding section 105 feeds the recording mediums fed one by one from the automatic paper feed tray 135 or the manual paper feed tray 139 to the transfer nip portion in synchronization with the conveying of toner images borne on the intermediate transfer belt 125 to the transfer nip portion.

The discharge section 106 includes the conveying roller 137, discharging rollers 140 and a catch tray 141. The conveying rollers 137 are disposed on a side of downstream in the paper conveying direction from the fixing nip portion, and convey the recording medium to which the images are fixed by the fixing section 104, to the discharging rollers 140. The discharging rollers 140 discharge the recording medium to which the images are fixed, to the catch tray 141 disposed at the upper surface of the image forming apparatus in the vertical direction. The catch tray 141 stores recording mediums to which the images are fixed.

The image forming apparatus 100 includes a control unit (not shown). The control unit is disposed, for example, in an upper portion in the inner space of the image forming apparatus and includes a memory portion, a computing portion, and a control portion. The memory portion of the control unit is inputted, for example, with various setting values via an operation panel (not shown) disposed to the upper surface of the image forming apparatus, detection result from sensors (not shown), etc. disposed at each portion in the image forming apparatus, and image information from external apparatuses. Further, programs for executing operations of various functional elements are written in the memory portion. The various functional elements are, for example, a recording medium judging section, an attachment amount control section, the fixing condition control section, etc. As the memory portion, those customarily used in this field can be used and examples thereof include read only memory (ROM), random access memory (RAM), and hard disk drive (HDD). As the external apparatuses, electric and electronic apparatuses capable of forming or acquiring image information and capable of being electrically connected with the image forming apparatus can be used, and examples thereof include a computer, a digital camera, a television set, a video recorder, a DVD (Digital Versatile Disc) recorder, HDDVD (High-Definition Digital Versatile Disc), a blu-ray disk recorder, a facsimile unit, and a portable terminal apparatus. The computing portion takes out various data written into the memory portion (image forming instruction, detection result, image formation, etc.) and programs for various functional elements to conduct various judgments. The control portion delivers control signals to the relevant apparatus in accordance with the result of judgment of the calculation section to conduct operation control. The control portion and the computing portion include a processing circuit provided by a microcomputer, a microprocessor, etc. provided with a central processing unit (CPU). The control unit includes a main power source together with the processing circuit described above, and the power source supplies power not only to the control unit but also to each of the devices in the inside of the image forming apparatus.

The developing device 114 of the invention effects the developing by using the two-component developer of the invention, and forms a highly fine toner image having high resolution and high quality on the photoreceptor drum 111. Further, the image forming apparatus 100 of the invention includes the developing device 114, and excellently reproduces the image of the manuscript and forms a highly fine image having high resolution and high quality.

EXAMPLES

The invention will now be concretely described by way of Examples and Comparative Examples. In the following description, "parts" and "%" are all "parts by weight" and "% by weight" unless stated otherwise.

| (Composition) | |
|---|---|
| Resin: Polyester (Tg: 60° C., Tm: 110° C.) | 87.5 parts by weight |
| Electric charge controller: TRH, manufactured by Hodogaya Chemical Co., Ltd. | 1.5 parts by weight |
| Releasing agent: Polyester wax (m.p. 85° C.) | 3 parts by weight |
| Coloring agent: KET, BLUE 111 | 8 parts by weight |

(Preparation of a Slurry of Fine Resin Particles)

By using a mixer (trade name: HENSCHELMIXER, manufactured by Mitsui Mining Co., Ltd.), the above-mentioned materials mentioned-above were mixed together, and the obtained mixture was melt-kneaded by using a biaxial extruder (trade name: PCM-30, manufactured by Ikegai, Ltd.) at a cylinder temperature of 145° C. and a barrel rotational speed of 300 rpm to prepare a melt-kneaded product for a starting toner. The melt-kneaded product was cooled down to room temperature, roughly pulverized by using a cutter mill (trade name: VM-16, manufactured by Seishin Enterprise Co., Ltd.) to prepare coarse particles having a particle size of not larger than 100 μm. 40 g of the above-mentioned coarse particles, 13.3 g of xanthanegum, 4 g of sodium dodecylbenzenesulfonate (trade name: Lunox S-100, anionic dispersant, manufactured by Toho Chemical Industry Co., Ltd.), 0.67 g of sulfosuccinic acid surfactant (trade name: Aerole CT-1p, chief component: sodium dioctylsulfosuccinate, manufactured by Toho Chemical Industry Co., Ltd.) and 742 g of water, were mixed together. The obtained mixture was thrown into a mixer (trade name: New Generation Mixer NGM-1.5TL, manufactured by Beryu Co., Ltd.), stirred at 2000 rpm for 5 minutes, and was deaerated to prepare a slurry of coarse particles. 800 g of the thus obtained slurry of coarse particles was thrown into a tank of a high-pressure homogenizer (trade name: NANO3000, manufactured by Beryu Co., Ltd.), and was circulated in the high-pressure homogenizer maintaining a temperature of not lower than 120° C. under a pressure of 210 MPa for 40 minutes to prepare a slurry containing fine resin particles having a volume average particle size of 2.5 μm. The high-pressure homogenizer used here was a conventional high-pressure homogenizer for pulverization.

(Preparation of Aggregated Particles)

800 g of the above-mentioned slurry of fine resin particles and 10 g of an aqueous solution containing 20% of stearyltrimethylammonium chloride (trade name: Khotamin 86W, manufactured by Kao Corporation) were thrown into the mixer (New Generation mixer NGM-1.5TL), stirred at 2000 rpm for 5 minutes, and were deaerated to prepare a slurry of fine resin particles containing a cationic dispersant. The whole amount of slurry of fine resin particles was thrown into the tank of the high-pressure homogenizer, and was circulated in the high-pressure homogenizer under a heated and pressurized condition of 70° C. and 13 MPa for 40 minutes to prepare a slurry of aggregated particles. The high-pressure homogenizer used here was a high-pressure homogenizer for aggregating particles shown in FIG. 1 but obtained by partly modifying the high-pressure homogenizer (trade name: NANO3000, manufactured by Beryu Co., Ltd.). The depressurizing module was the one shown in FIG. 2 having a nozzle length of 150 mm, a nozzle inlet diameter of 0.3 mm and a nozzle outlet diameter of 2.5 mm.

The obtained slurry of aggregated particles was filtered to take out the aggregated particles which were washed with water 5 times and were dried with the hot air heated at 75° C. to thereby manufacture the aggregated particles.

TABLE 1

| | Cell length (mm) | θ | δ | Number of depressurizing modules | Temp. (° C.) | Cationic aggregating agent | Amount of cationic aggregating agent | Anionic aggregating agent | Amount of anionic aggregating agent | |
|---|---|---|---|---|---|---|---|---|---|---|
| Example 1 | 10 | 30 deg | 45 deg | 2 | 90 | NaCl | 2% | DBS | 1.0% | With ring |
| Example 2 | 10 | 30 deg | 45 deg | 2 | 75 | NaCl | 3% | DBS | 1.0% | With ring |
| Example 3 | 10 | 30 deg | 45 deg | 2 | 60 | NaCl | 5% | DBS | 1.0% | With ring |
| Example 4 | 10 | 30 deg | 45 deg | 2 | 75 | $MgCl_2$ | 0.5% | DBS | 1.0% | With ring |
| Example 5 | 10 | 30 deg | 45 deg | 2 | 75 | $CaCl_2$ | 0.5% | DBS | 1.0% | With ring |
| Example 6 | 10 | 30 deg | 45 deg | 2 | 75 | KCl | 3% | DBS | 1.0% | With ring |
| Example 7 | 10 | 30 deg | 45 deg | 2 | 75 | NaCl | 2% | SA | 0.5% | With ring |
| Example 8 | 10 | 45 deg | 45 deg | 2 | 75 | NaCl | 3% | DBS | 1.0% | With ring |
| Example 9 | 10 | 30 deg | 60 deg | 2 | 75 | NaCl | 3% | DBS | 1.0% | With ring |
| Example 10 | 10 | 45 deg | 60 deg | 2 | 75 | NaCl | 3% | DBS | 1.0% | With ring |
| Example 11 | 10 | 30 deg | 45 deg | 1 | 75 | NaCl | 3% | DBS | 1.0% | With ring |
| Example 12 | 10 | 30 deg | 45 deg | 2 | 55 | NaCl | 3% | DBS | 1.0% | With ring |
| Example 13 | 10 | 0 deg | 45 deg | 2 | 75 | NaCl | 5% | DBS | 1.0% | With ring |
| Example 14 | 10 | 30 deg | 45 deg | 2 | 75 | NaCl | 0.5% | DBS | 1.0% | Without ring |

Toners were prepared in Examples 1 to 10 and in Comparative Examples 1 to 4 under the conditions shown in Table 1.

In Table 1, θ [deg] stands for the angle of the flow path 12 In the first depressurizing module 6 with respect to the axis, and δ [deg] stands for a positional relationship between the opening of the flow path 12 on the end surface on the front side and the opening of the flow path 12 on the end surface on the back side when the cylindrical member 11 is viewed from the direction of the axis, and is an angle subtended by two imaginary lines drawn from the center to the centers of the respective openings.

(Manufacturing of Two-Component Developer)

A ferrite core carrier having a volume average particle size of 45 μm was used as the carrier. The toner and the carrier were mixed together for 20 minutes by using a V-type mixer (trade name: V-5, manufactured by Tokuju Corporation) in a manner that the ratio of covering the carrier with toner was 60% in Examples 1 to 10 and in Comparative Examples 1 to 4 in order to manufacture the two-component developer.

(Volume Average Particle Size and Particle Size Distribution of Toner)

A sample for measurement was prepared by adding 20 mg of the sample and 1 ml of sodium alkyl ether sulfate to 50 ml of an electrolyte (trade name: ISOTON-II, manufactured by Beckman Coulter Inc.), and dispersing the mixture by using an ultrasonic wave dispersion device (trade name: UH-50, manufactured by STM Corporation) at an ultrasonic wave frequency of 20 kHz for 3 minutes. By using a particle size distribution-measuring device (trade name: Multisizer 3, manufactured by Beckman Coulter Inc.), the sample for measurement was measured under the conditions of an aperture diameter of 20 μm and number of particles to be measured: 50,000 counts. A volume average particle size was found from the volume particle size distribution of the sample particles, and a standard deviation was found in the volume particle size distribution. The coefficient of variation (CV value %) was calculated based on the following formula, CV value (%)=(Standard deviation in the volume particle size distribution/volume average particle size)×100

(Missing Dots)

The two-component developer containing the toner was filled in the image forming apparatus of the invention, the toner attachment amount on the photoreceptor was adjusted to be 0.4 mg/cm$^2$, and an image of 3×5-isolated dots was formed. The image of 3×5-isolated dots is an image in which a plurality of dot portions of a size of longitudinal 3 dots and transverse 3 dots are so formed that the gap among the neighboring dot portions is 5 dots on 600 dpi (dots per inch). The formed image was displayed on a monitor being enlarged into 100 times by using an optical microscope (trade name: VHX-600, manufactured by Keyence Co.), and the number of missing dots was confirmed among seventy 3×5 isolated dots. The evaluation was made on the following basis.

Good: Favorable. Less than 5 dots were missing.

Not Bad: Practically usable. Less than 10 dots were missing.

Poor: No Good. Not less than 10 dots were missing.

(Fogging)

The two-component developer was filled in a commercially available copier (trade name: MX-2300G, manufactured by Sharp Corporation), the toner attachment amount on the photoreceptor drum was adjusted to be 0.4 mg/cm$^2$, and an image including an image portion and a non-image portion was formed. The toner attached on the non-image portion in the formed image was picked up by using an adhesive tape, and the image density (ID) was measured by using a colorimetric color difference meter (trade name: X-Rite, manufactured by X-Rite Co.). The togging was evaluated on the following basis:

Good: Favorable. ID was less than 0.1.

Not Bad: Practically flawless. ID was less than 0.2.

Poor: No Good. ID was not less than 0.2.

(Comprehensive Evaluation)

The comprehensive evaluation was on the following basis:

Good: Very favorable. Both missing of dots and fogging were evaluated as "Good".

Not Bad: Favorable. There was no evaluation "Poor" concerning missing of dots and fogging, but at least one of them was evaluated as "Not Bad".

Poor: Practically flawless. At least one of missing of dots and fogging was evaluated as "Poor".

The results of evaluation are shown in Table 2.

TABLE 2

| | | | Image quality | | |
|---|---|---|---|---|---|
| | Dp [μm] | CV [%] | Missing of dots | Fogging | Comprehensive evaluation |
| Example 1 | 5.4 | 22 | Good | Good | Good |
| Example 2 | 5.8 | 25 | Good | Good | Good |
| Example 3 | 6.3 | 27 | Good | Good | Good |
| Example 4 | 5.3 | 24 | Good | Good | Good |
| Example 5 | 5.8 | 26 | Good | Good | Good |
| Example 6 | 5.2 | 21 | Good | Good | Good |
| Example 7 | 5.8 | 25 | Good | Good | Good |
| Example 8 | 6.3 | 24 | Good | Good | Good |
| Example 9 | 6.7 | 25 | Good | Good | Good |
| Example 10 | 4.1 | 34 | Not Bad | Not Bad | Not Bad |
| Example 11 | 3.1 | 45 | Not Bad | Poor | Poor |
| Example 12 | 1.9 | 43 | Poor | Poor | Poor |
| Example 13 | 2.3 | 74 | Poor | Poor | Poor |
| Example 14 | 26.4 | 116 | Poor | Poor | Poor |

Only one depressurizing module was used in Example 11, the liquid temperature of the aqueous slurry in the depressurizing module was outside the favorable range in Example 12, the content of the cationic aggregating agent was outside the favorable range in Example 13, and no ring member was used in Example 14. Therefore, missing of dots and fogging were not favorable in these Examples 11, 12, 13 and 14.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of manufacturing toner particles comprising:

an aggregating step of obtaining an aqueous slurry of aggregated particles by passing an aqueous slurry of fine resin particles through a depressurizing module under heated and reduced pressure conditions; and a cooling step of cooling the aqueous slurry of aggregated particles.

2. The method of manufacturing toner particles of claim 1, wherein a flow path constituted in the depressurizing module has a straight portion that is tilted with respect to a direction in which the aqueous slurry passes and a portion for relaxing the flow of the aqueous slurry.

3. The method of manufacturing toner particles of claim 1, wherein the depressurizing module is constituted by alternately stacking ring-like members and cylindrical members in concentric, and the cylindrical members form a flow path that penetrates through in the axial direction and is tilted with respect to the axis.

4. The method of manufacturing toner particles of claim 1, wherein the liquid temperature of the aqueous slurry in the depressurizing module is from 60 to 90 CC in the aggregating step.

5. The method of manufacturing toner particles of claim 1, wherein two or more depressurizing modules are connected in series to pass the aqueous slurry in the aggregating step.

6. The method of manufacturing toner particles of claim 1, wherein the aqueous slurry of fine resin particles contains a cationic aggregating agent.

7. The method of manufacturing toner particles of claim 6, wherein the cationic aggregating agent is contained in an amount of 0.1 to 5% by weight based on the whole amount of the aqueous slurry of fine resin particles.

8. The method of manufacturing toner particles of claim 6, wherein the cationic aggregating agent comprises one or two or more selected from potassium chloride, sodium chloride, calcium chloride, magnesium chloride and aluminum chloride.

9. The method of manufacturing toner particles of claim 6, wherein the aqueous slurry of fine resin particles further contains an anionic dispersant.

10. The method of manufacturing toner particles of claim 9, wherein the anionic dispersant comprises one or two or more selected from sulfonic acid anionic dispersant, sulfuric acid ester anionic dispersant, phosphoric acid ester anionic dispersant and polyacrylate.

* * * * *